US005363527A

United States Patent [19]

Rainaud et al.

[11] Patent Number: 5,363,527

[45] Date of Patent: Nov. 15, 1994

[54] SPANNING BEAM STRUCTURE FOR CLEARING BREACHES BY VEHICLES

[75] Inventors: Guy Rainaud; Denis Allain, both of Toulon; Henri Aubert, La Seyne sur Mer, all of France

[73] Assignee: Constructions Industrielles de la Mediterranee CNIM, Paris, France

[21] Appl. No.: 977,283

[22] Filed: Nov. 13, 1992

[30] Foreign Application Priority Data

Nov. 15, 1991 [FR] France ..... 91 14116

[51] Int. Cl.[5] ..... E01D 15/12

[52] U.S. Cl. ..... 14/2.4; 14/2.5

[58] Field of Search ..... 14/25, 2.6, 2.4

[56] References Cited

U.S. PATENT DOCUMENTS 4,393,533 7/1983 Terrien et al. ..... 14/2.6
4,413,369 11/1983 Terrien et al. ..... 14/2.6 X
5,179,751 1/1993 Wiedeck ..... 14/2.4

FOREIGN PATENT DOCUMENTS 0340409 11/1989 European Pat. Off. .
0362065 4/1990 European Pat. Off. .
0374019 6/1990 European Pat. Off. .
407274 1/1991 European Pat. Off. ..... 14/2.4
2158618 6/1973 France .

*Primary Examiner*—Ramon S. Britts
*Assistant Examiner*—James A. Lisehora
*Attorney, Agent, or Firm*—Steinberg, Raskin & Davidson

[57] ABSTRACT

A spanning beam structure for clearing breaches by vehicles, having a locking member including at least one pair of locking shafts made fast to a raisable access jib and to a central box, respectively, of the spanning beam while extending longitudinally of the central box along the same axis in the locked position of the access jib and two jaw-like members gripping round to confronting heads of both locking shafts.

15 Claims, 22 Drawing Sheets

7
8
9
11
12
13
14
15
16
22
21
29
34
37
38
XII

SPANNING BEAM STRUCTURE FOR CLEARING BREACHES BY VEHICLES

BACKGROUND OF THE INVENTION

The present invention relates to a spanning beam structure adapted in particular to the clearing of breaches by vehicles such as armoured vehicles of the Engineer Corps and a system for transporting, on a vehicle, of at least two bridging spanning beams adapted to the clearing of breaches and for depositing spanning beams over or above breaches from the vehicle.

There are already known systems allowing to deposit a spanning beam of short length or of greater length after endwise assembly of two or three spanning beams of short lengths from a vehicle. These known systems however are of an extremely complex and sophisticated design and involve a relatively large overhang or cantilever of a launching girder with respect to the vehicle upon the depositing of spanning beams, which overhang or cantilever has to be taken up by suitable means further increasing the bulk or size and the complexity of the system. Moreover the structure of each one of the spanning beams used in these known systems is complicated too and leads to a relatively great mass or weight of spanning beam.

OBJECTS AND SUMMARY OF THE INVENTION

The object of the present invention is to remove the inconveniences referred to hereinabove by at first providing a spanning beam structure adapted in particular to the clearing of breaches by vehicles such as armoured vehicles of the Engineer Corps, formed of at least one spanning beam element comprising a rigid central box with an upper treadway and two access jibs assembled to both ends of the central box, respectively, so as to extend the trackway of the central box, at least one of the access jibs being upwards swingable and fastened to the central box by a transverse pivot pin and unlockable locking means and which is characterized in that the locking means comprise at least one pair of locking shafts made fast to the upwards swingable access jib and to the central box while extending longitudinally of the central box along the same axis in the locked position of the access jib and two jaw-like members tightly gripping round two mutually confronting heads of the locking shafts.

According to a characterizing feature of the invention the pivot pin of the upwards swingable access jib is located at the upper part of the central box and the locking shafts are located approximately at the bottoms of the access jib and of the central box with both jaw-shaped members accommodated in a lower transverse space defined between the upward swingable access jib and the central box.

Advantageously the spanning beam structure comprises at least one retractable pin for taking up shearing forces exerted upon the locking shafts upon the passage of the vehicles on the aforesaid trackway and extending longitudinally into two coaxial holes of the upwards swingable access jib and of the central box, respectively.

The aforesaid pin is retracted from the hole of the upwards swingable access jib by a control rod with a threaded end screwed into the pin and mounted for rotation about its axis in a block made fast to the central box so as to fully retract the pin into the hole of the central box formed in the block in coaxial relation to the control rod upon the unlocking of the upwards swingable jib.

According to still another characterizing feature of the invention both jaw-like members are operated by a mechanism mechanically connected to the control rod and comprising a plate with a guided longitudinal movement controlled by the control rod and two stubs made fast to both jaw-shaped members, respectively, inserted into two oblique grooves, respectively, of the plate so that the controlled motion of the latter moves both jaw-like members towards or away from each other.

The aforesaid control rod comprises a cross pin made fast to the plate through one longitudinal groove formed in one wall of the aforesaid block and the plate is made fast to the block preferably by two parallel L-shaped guiding rails.

At least one pin for guiding the movement of both jaw-like members towards or away from each other is made fast to the central box of the spanning beam element.

Advantageously the spanning beam structure comprises a reducing mechanism mechanically connected to the drive means of the jaw-like members and made fast to the bottom of the central box so as to be removably coupled to an outer drive motor.

Preferably the other access jib of the spanning beam element is stationary and comprises a transverse bar for locking a hook-shaped portion at the end of a movable jib unlocked from another similar spanning beam element, a member for unlocking the hook-shaped portion from the transverse bar and preferably constituted by a jack made fast to the stationary access jib and the jack rod of which lifts or raises the upwards swingable access jib of the other spanning beam element and at least one locking pin extending longitudinally of the central box and which may be locked by jaw-like members to the locking pin of the central box of the other spanning beam element when the upwards swingable access jib of the latter is locked to the transverse bar.

The spanning beam structure comprises two spanning beam elements with parallel treadways and the central boxes of which are connected to each other by two connecting arms forming braces and two access jibs forward or rearward of the structure are stationary and upwards swingable, respectively.

The invention also provides a system for the transfer on a road vehicle such as a truck or a lorry of at least two bridging spanning beams superimposed on a frame of the vehicle, which may be assembled end to end and for depositing each one of the spanning beams or both spanning beams assembled end to end above or over breaches to be cleared, each spanning beam having a structure such as previously defined and of the type comprising a girder for supporting and launching one spanning beam or assembled spanning beams and displaceable in relation to the vehicle towards an overhang or cantilever position at the front portion of the latter, means for displacing the spanning beam or assembled spanning beams in relation to the supporting and launching girder to an overhang or cantilever position at the forward portion of the said girder and a plate supporting in guiding relationship the supporting and launching girder and rocking or tilting in relation to the vehicle to allow to deposit the spanning beam or assembled spanning beams and which is characterized in that it comprises at least one controlled hook for depositing the spanning beam or assembled spanning beams, mounted at the end of the supporting and launching girder and capable of assuming a relative position for supporting a shaft for handling the spanning beam or assembled spanning beams, located opposite to that end of the spanning beam or of assembled spanning beams which is bearing upon that bank of the breach to the cleared which is opposite to the vehicle through tilting or rocking of the supporting plate, from which supporting position the hook is lowered for depositing the other end of the spanning beam or assembled spanning beams on that bank of the breach which is close to the vehicle.

The overhang or cantilever position of the supporting and launching girder at the front of the vehicle upon depositing the spanning beam or assembled spanning beams is relatively reduced by about one quarter of its full length.

Preferably the means for displacing the spanning beam or assembled spanning beams in relation to the aforesaid girder comprise two endless drive chains arranged on either side of the girder and mounted each one on two toothed wheels fastened to the ends of the girder with the lower side of each drive chain passing or being reeved over three toothed guide wheels arranged according to a triangle configuration and made fast to the supporting and rocking plate, a motor-reduction gear set for simultaneously driving two of the guide pinions of both drive chains, respectively, and fastened to the supporting and tilting plate and at least two pairs of elements forming retractable forks, fastened to both drive chains, respectively, in symmetric relation to the longitudinal center line axis of the girder, each pair of fork-like elements gripping one corresponding projecting portion of the central box of one spanning beam located plumb with a handling shaft underneath the latter.

Both pair of fork-shaped elements are simultaneously brought into a position for gripping aforesaid projecting portions or into a position retracted by a mechanical mechanism operated by a control device fastened to the supporting and rocking plate.

Advantageously each pair of fork-like elements comprises two brackets or dogs pivotally mounted in mutually confronting relationship on two parallel pins of links of one drive chain and the aforesaid mechanism comprises two transverse shafts rotatably mounted in the aforesaid girder and rotated together by two meshing toothed wheels made fast to both transverse shafts, respectively, supporting each one at their ends two external cams pushing two arms, respectively, pivotally mounted on the girder below upper sides of both drive chains so as to lift or raise the corresponding dogs or brackets into a position projecting above the plane passing on the upper sides of both drive chains and a plate pivotally mounted on one single side of the girder and having one of its ends connected to a control rod and its opposite end comprising a notch engaged in pivoting relationship by the end of one arm for pivoting one of the thrust cams, the pivoting plate being thus capable to tilting or rooking between an operative position for locking the dogs or brackets in their aforesaid gripping position and an inoperative position of retracting the dogs or brackets.

The aforesaid control device comprises an element such as a plate perpendicular to the supporting and tilting plate and vertically movable between a low position and a high position and acting in the stationary position of the girder in relation to the supporting and rocking plate upon a roller made fast to the end of one arm swinging in relation to the girder and forming together with the aforesaid control triangle and the notched pivoting plate a parallelogram deformable between both aforesaid positions of tilting of the pivoting plate.

The aforesaid supporting and rocking plate is located at the front of the vehicle and the aforesaid girder has its portion backwards of the supporting and rocking plate, in the rest or inoperative position of the girder, accommodated between both overlying spanning beams and the connecting arms of both overlying spanning beams, with both connecting arms of the lower spanning beam being each one U-shaped and pivotally connected at its ends to both inner side walls, respectively, of both central boxes of both lower spanning beam elements and being capable of being simultaneously raised to a position parallel to the frame and locked to the lower spanning beam, both U-shaped connecting arms thus increasing, in the lowered position, the room or space for housing the girder.

The system moreover comprises a means for raising the connecting arms of the inner spanning beam elements, consisting of a lifting table mounted on the frame of the vehicle so as to assume an inoperative lowered position and which may be raised from its inoperative position after retraction of the girder from above the lower spanning beam so as to act upon the lower ends of the U-shaped connecting arms and to move them away from each other to the parallel position of locking of the connecting arms of the lower spanning beam.

Preferably two hooks for supporting both handling shafts, respectively, made fast in confronting relationship to two spanning beam elements, respectively, are provided and are fastened to the ends of two operating chains mounted on two parallel toothed wheels, respectively, at the end of the girder and driven by a reducing mechanism fastened to the girder and controlled by a preferably hydraulic motor fastened to the supporting and tilting plate and mechanically coupled through a removable connection to the reducing mechanism at determined fixed positions of the girder in relation to the supporting and rocking plate.

Each aforesaid hook comprises a latch for locking a handling shaft and arranged to co-operate with the upper edge of the corresponding side wall of the girder upon a controlled displacement of the hook in the direction reverse from that of lowering of the hook so as to be unlocked by the action of an elastic member in a relative position of the hook receiving the corresponding handling shaft and the hook is then displaced over a relatively small stroke simultaneously with the spanning beam in the direction of downward motion of the hook so as to automatically bring the latch into the position of locking the handling shaft in the hook.

The aforesaid girder is displaced in a translatory motion in the longitudinal direction in relation to the supporting and tilting plate by a motor-reducing gear set fastened underneath the said plate driving at least one drive pinion meshing with a longitudinal toothed rack fastened below the girder which comprises at the upper portion tracks forming rails for guiding the spanning beams on which are moving rollers for the travel of the spanning beams.

The system also comprises a device for operating the tilting of the aforesaid supporting plate, comprising two side cables passing over two pulleys, respectively, made fast to the supporting plate rearwards of the tilting axis of the said plate while defining two sides perpendicular to the frame of the vehicle, anchored to the latter and two parallel sides extending along the frame and winding up on two drums, respectively, of a winch driven by a motor-reducing gear set made fast to the frame at the rear of the vehicle.

Advantageously, both aforesaid perpendicular sides have their ends connected to a balancer in the shape of a bar parallel to the frame of the vehicle and mounted for swinging motion about a central longitudinal shaft made fast to a clevis fastened to the frame of the vehicle and the parallel sides are extending back to the pulleys of the supporting plate through the medium of guide pulleys.

The system in addition comprises two pairs of jacks arranged on either side of the vehicle so as to lift the lower spanning beam after disengagement of the upper spanning beam on the girder at the level of the upper spanning beam with a view to couple it endwise of the latter.

Each spanning beam comprises two pairs of front and rear handling shafts, respectively, two handling shafts of each pair being fastened in confronting relationship to both central boxes, respectively, of both spanning beam elements at the upper part thereof.

BRIEF DESCRIPTION OF THE DRAWINGS

The invention will be better understood and further objects, characterizing features, details and advantages thereof will appear more clearly as following explanatory description proceeds with reference to the accompanying diagrammatic drawings given by way of non limiting example only illustrating a presently preferred specific embodiment of the invention and wherein.

DETAILED DESCRIPTION OF THE INVENTION

Figure 1:
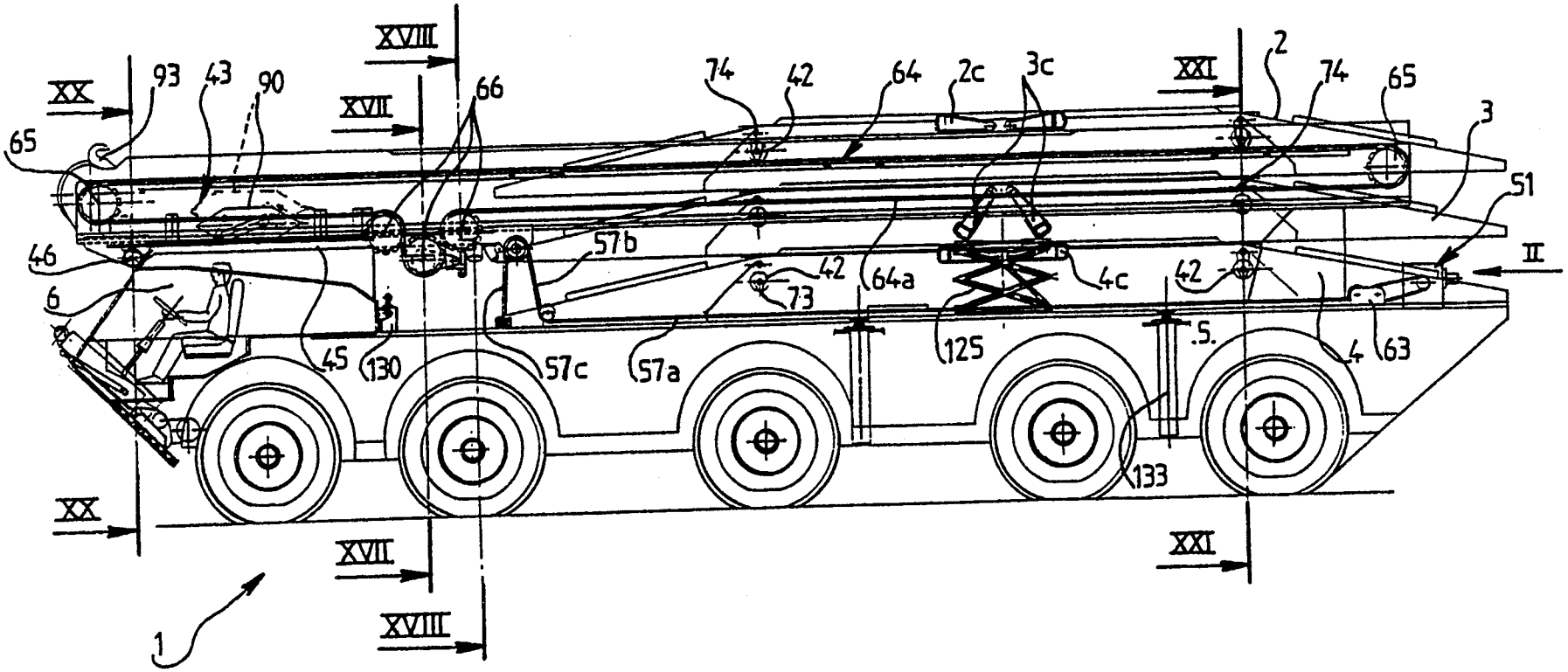
FIG. 1 shows a road vehicle provided with a system according to the invention in the transport position and allowing to deposit spanning beams above or over breaches to be cleared.
Figure 5:
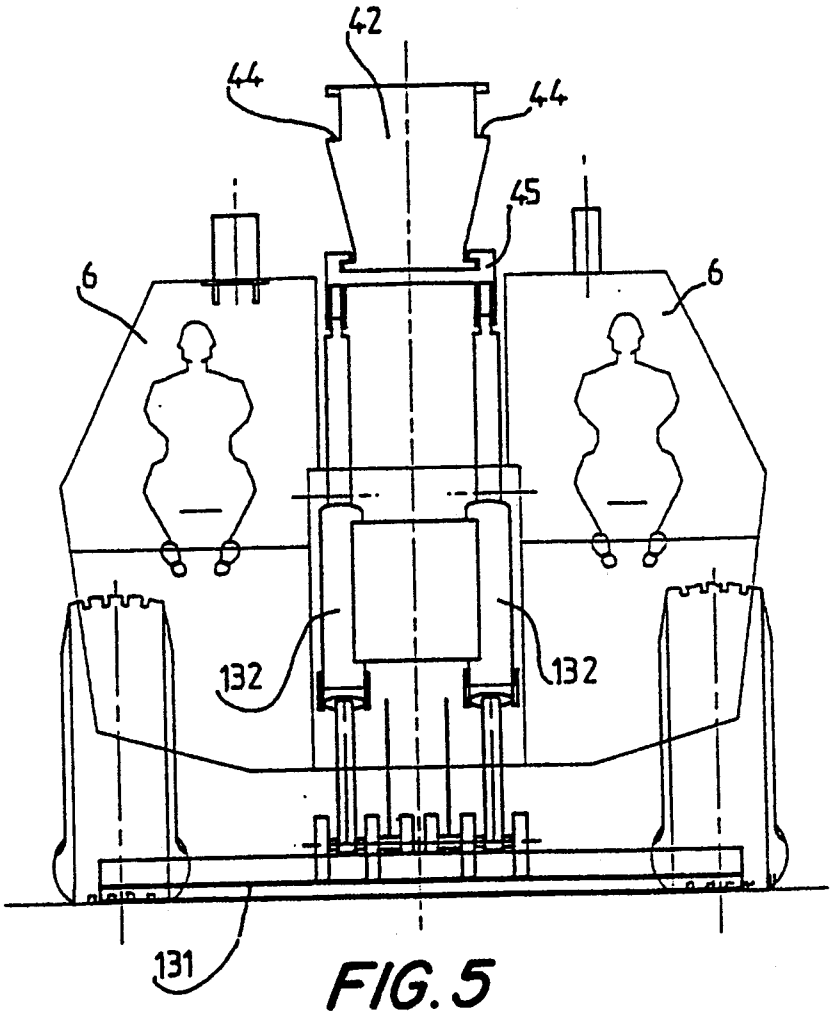
FIG. 5 is a view according to the arrow V of FIG. 3.
Figure 2:
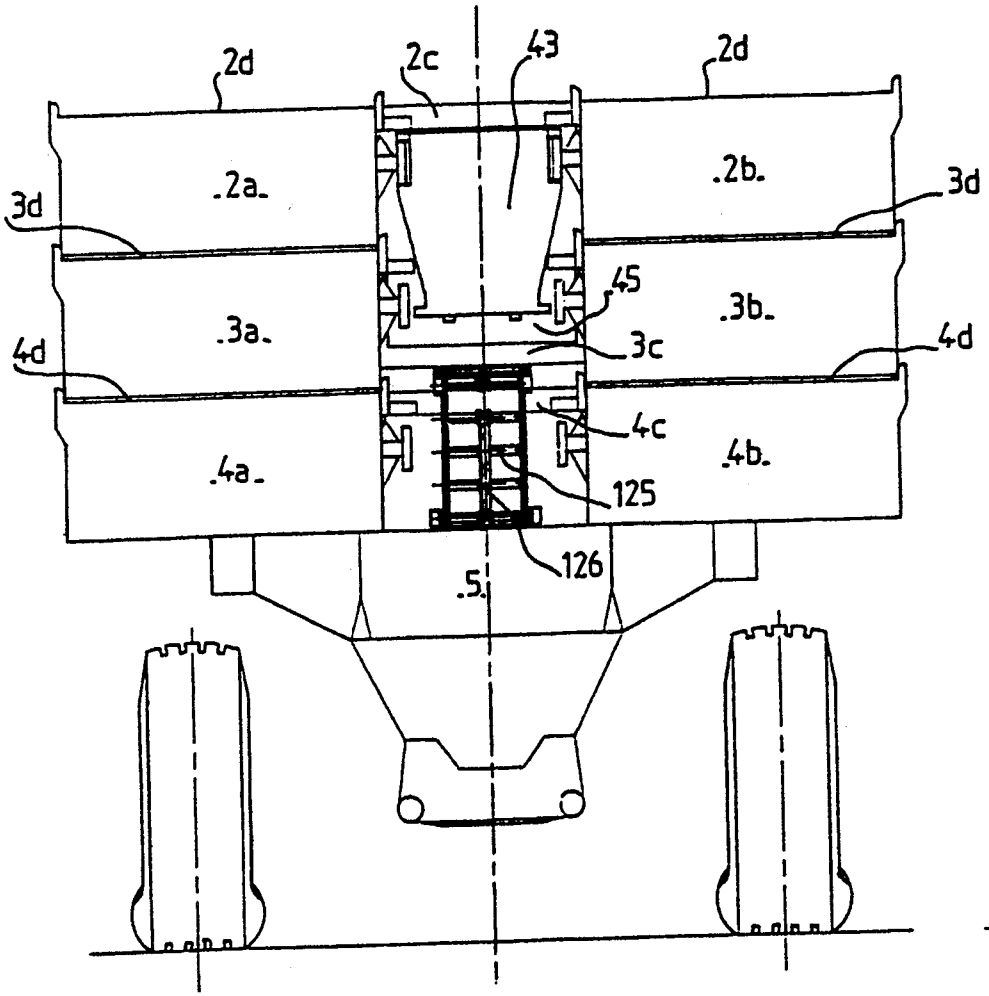
FIG. 2 is a view in the direction of the arrow II of FIG. 1.
Figure 3:
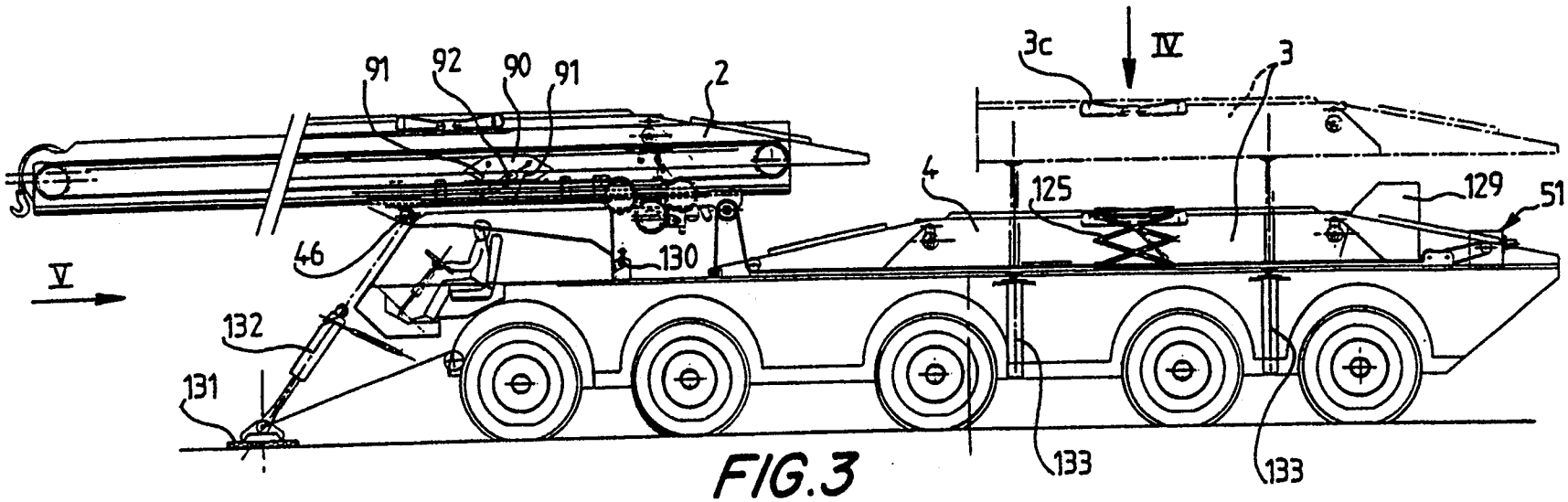
FIG. 3 is a view similar to that of FIG. 1 but showing the system in its configuration prior to laying down a spanning beam.
Figure 4:
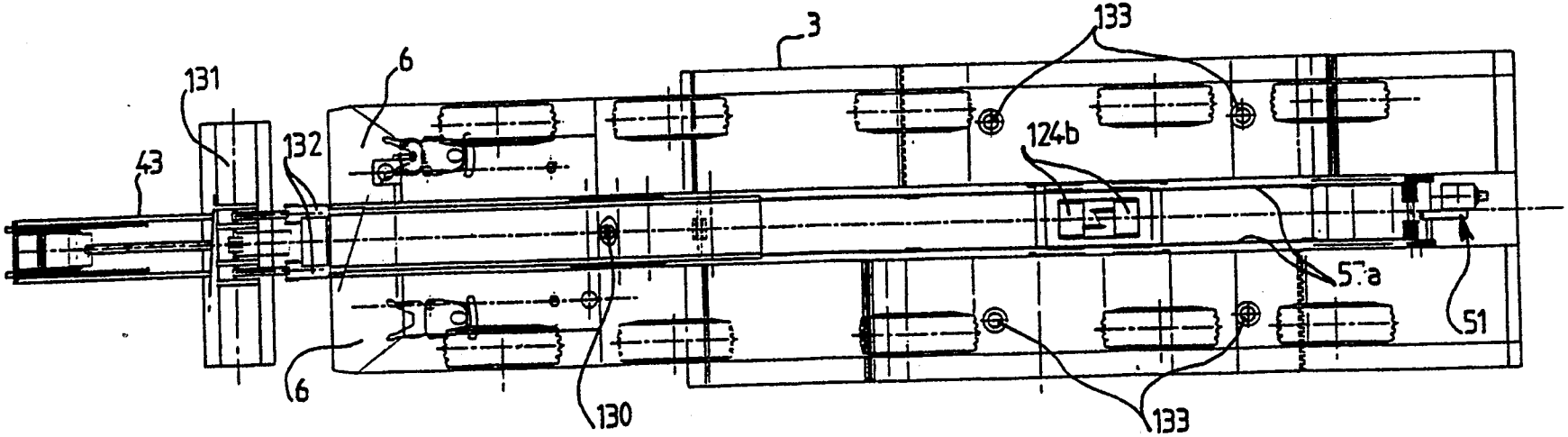
FIG. 4 is a top view according to the arrow IV of FIG. 3.
Figure 6:
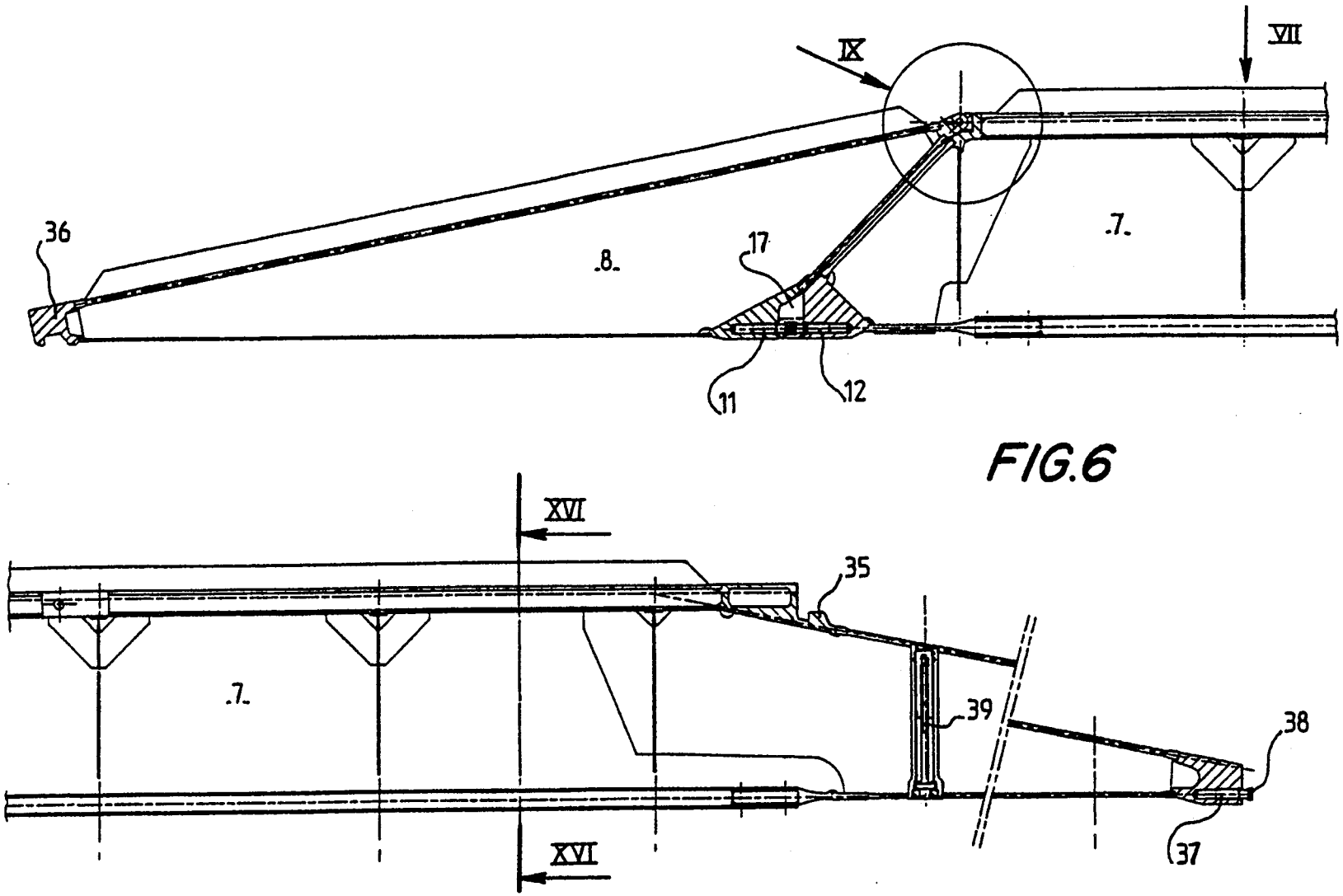
FIG. 6 shows a side view of a spanning beam according to the invention.

Referring to FIGS. 1 to 36 the reference numeral 1 designates a road vehicle such as a truck or a lorry allowing to carry towards at least one breach to be cleared by vehicles such for instance as armoured vehicles of the Engineer Corps, three spanning beams superimposed on a longitudinal frame 5 of the vehicle and consisting of an upper spanning beam 2, an intermediate spanning beam 3 and a lower spanning beam 4, respectively.

The vehicle 1 comprising a double front cabin 6 extended rearwards by the longitudinal frame 5 supports a system adapted for separately depositing the spanning beams 2, 3, 4 over or above breaches or to assemble at least two spanning beams end to end and to deposit the assembled spanning beams above a breach.

The spanning beams 2, 3 and 4 are identical and are each one formed of two parallel spanning beam elements *2a, 2b; 3a, 3b; 4a, 4b* assembled by two connecting arms forming braces *2c, 3c* and *4c*. Both spanning beam elements of each spanning beam 2, 3, 4 comprise two parallel top trackways *2d, 3d* and *4d*.

According to the invention each spanning beam element comprises a rigid central box 7 and two access jibs 8, 9 assembled to both ends of the central box 7, respectively, so as to extend the top trackway of the central box. The access jib 8 is fastened at the upper part of the central box 7 by a transverse pivot pin 10 and at the lower part of the central box 7 by locking means which are unlockable so as to allow the jib 8 to be raised or swung upwards about its pivot pin 10. These locking means comprise at least two locking shafts or bolts 11, 12 made fast to the movable access jib 8 and to the central box 7, respectively also referred to as jib locking shaft 11 and box locking shaft 12. By way of example twenty pairs of locking bolts 11, 12 are provided in parallel relationship in a same plane forming the bottom of the spanning beam element. Thus the looking shafts or bolts 11, 12 in the locked position of the movable jib 8 are extending in parallel relation to the longitudinal axis of the spanning beam element with two shafts or bolts of a same pair being aligned. The locking means moreover comprise two jaw-like members 13, 14 tightly gripping round or clamping mutually confronting heads 15, 16, respectively, of the locking bolts 11 and 12. Both jaw-shaped members 13, 14 are arranged transversely of the longitudinal axis of the spanning beam element within a lower space 17 defined between the movable access jib 8 and the central box 7. For taking up the shearing forces exerted upon the locking bolts 11, 12 upon the passing or travelling of vehicles on the trackway of each spanning beam element, there are provided two longitudinal retractable pins 18 of which a single one is shown and located on either side of both ends of the two jaw-like members 13, 14, respectively. Each pin 18 in the locked position of the movable jib 8 extends into two coaxial passage-ways or holes 19, 20 formed in the movable jib 8 and in a block 21, respectively, secured to the central box 7 by fastening screws 22. Each pin 18 comprises a thoroughfare tapped hole 23 into which is screwed one threaded end of a control rod or spindle 24 mounted for rotation about its longitudinal center line axis in the block 21. The control rod 24 extends longitudinally of the central box 7 to a first reducing mechanism 25 fastened at the bottom of the central box 7. The reducing mechanism 25 is driven by a transverse shaft 26 itself rotated by a second central reducing mechanism 27 also fastened at the bottom of the central box 7. The reducing mechanism 27 may be actuated by an external preferably hydraulic motor, removably coupled to the reducing mechanism 27 as will be explained later. Advantageously as better shown on FIG. 14, both jaw-shaped members 13, 14 and both pins 18 of a spanning beam element are simultaneously operated by a control mechanism comprising in the vicinity of each one of the ends of the jaw-like members 13, 14 a plate 28 fastened to the block 21 in guided relationship, for instance by two guide rails 29 so as to be capable of displacing itself along a longitudinal direction between two end positions of closing of the jaw-like members 13, 14 and of insertion of each pin 18 into the corresponding passage-way 19 and of opening of the jaw-like members 13, 14 and of full retraction of each pin 18 into the corresponding passage-way 20 of the block 21, respectively. For that purpose each plate 28 is driven in a longitudinal translatory motion by a stub shaft 30 made fast to the corresponding pin 18 and extending through a longitudinal groove 31 of a wall of the block 21 while having its end made fast to one face of the movable plate 28 the opposite face of which comprises two oblique grooves 32 into which are inserted two transverse studs 33, respectively, fastened to the ends of both jaw-shaped members 13, 14. Thus to obtain the unlocking of a movable access jib 8, the external hydraulic motor is coupled to the reducing mechanism 27 and operated for rotating the spindles 26 which are themselves rotating both control rods 24 causing the longitudinal displacement of the pins 18 into the fully retracted position into the passage-ways 20 of the blocks 21. The displacement of the pins 18 causes a concurrent displacement of both plates 28 towards the right with respect to FIG. 14 so as to spread apart both jaw-like members 13, 14. Reversely a displacement by the control rods 24 of the pins 18 in the passage-ways 19 of the movable access jib in the lowered position causes a displacement towards the left of the plates 28 and thereby the movement of both jaw-like members 13, 14 towards each other into the locking position of the locking bolts 11, 12. The relative displacement of both jaw-like members 13, 14 is provided by two parallel guide shafts 34 located in the vicinity of both ends of both jaw-shaped members 13, 14 and made fast to the central box 7 of the spanning beam element.

Figure 8:
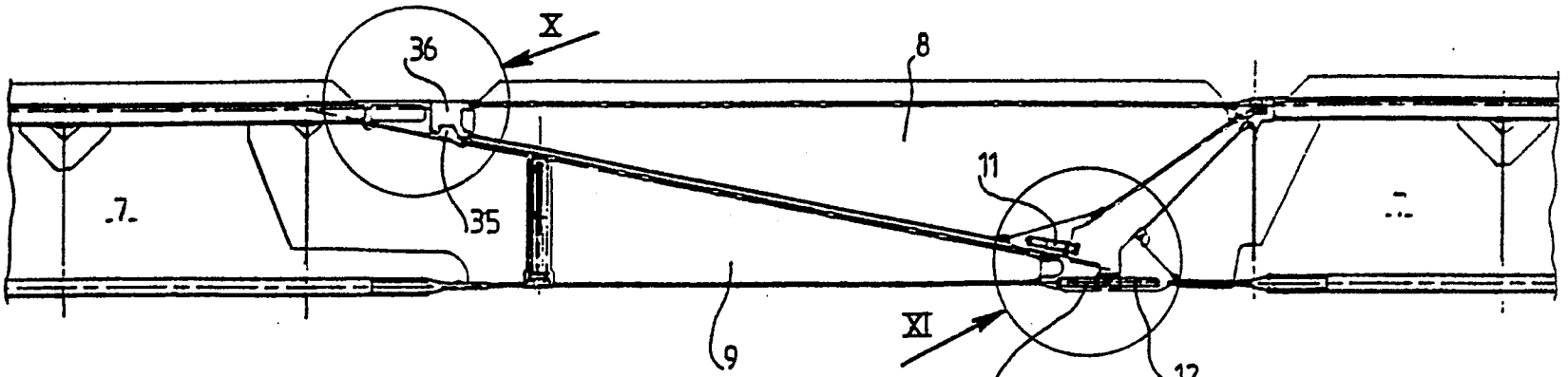
FIG. 8 partially shows two spanning beam elements assembled end to end.
Figure 10:
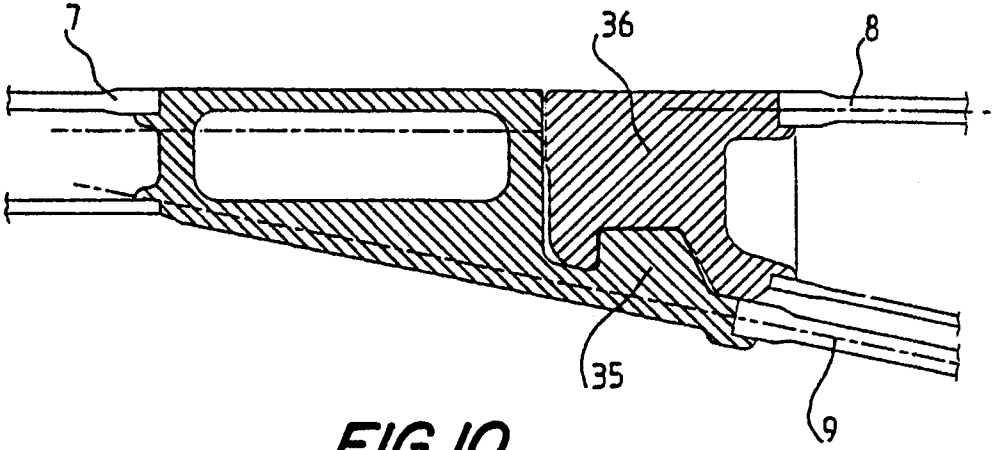
FIG. 10 is an enlarged view of the portion circled at X of FIG. 8.
Figure 9:
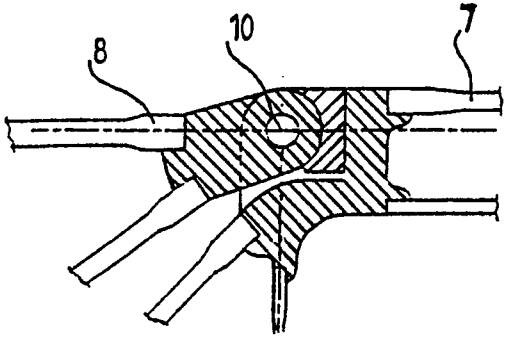
FIG. 9 is an enlarged view of the portion circled at IX of FIG. 6.
Figures 11, 12, 13:
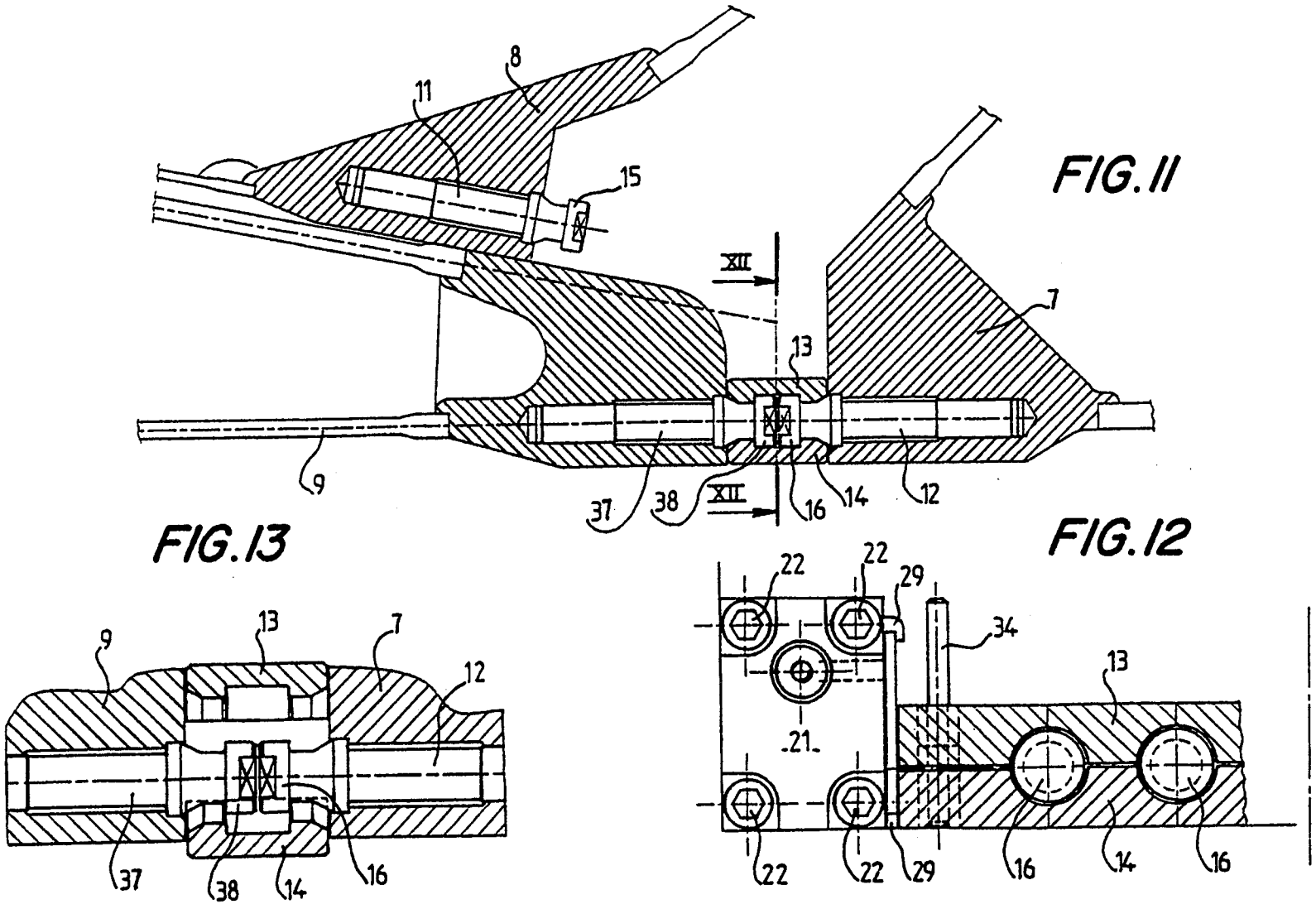
FIG. 11 is an enlarged view of the portion circled at XI of FIG. 8.
FIG. 12 is a view in section taken upon the line XII—XII of FIG. 11.
FIG. 13 is a sectional view showing two jaw-elements of locking pins in the unlocked spread position.
Figure 15:
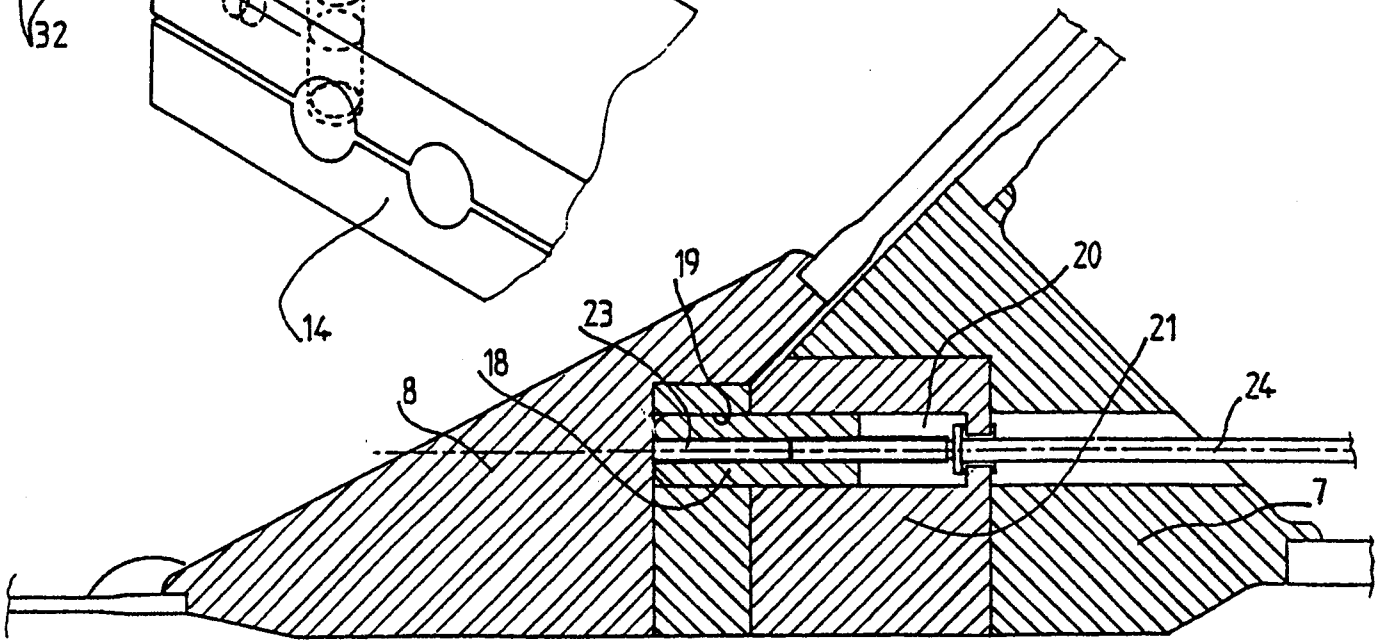
FIG. 15 is an enlarged sectional view showing a bolt for taking up shearing stresses exerted upon the locking pins during the passing of vehicles on the spanning beam.
Figure 14:
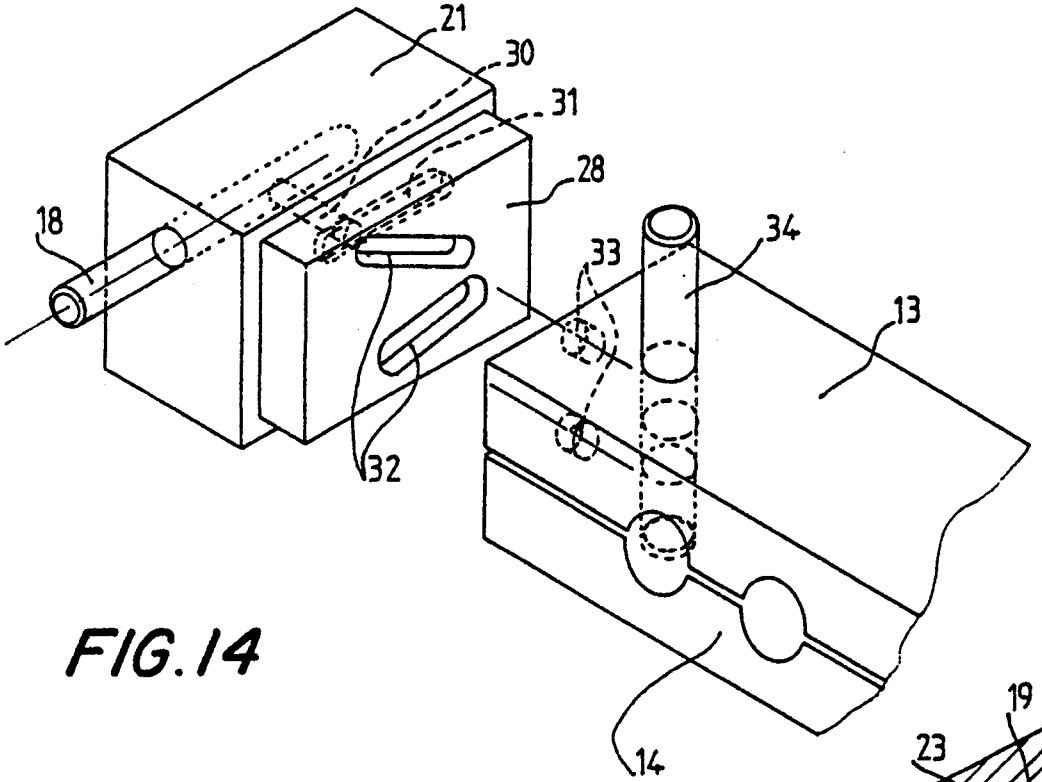
FIG. 14 is a perspective view of the mechanism allowing in particular to operate the jaw-like elements for locking the locking pins.
Figure 16:
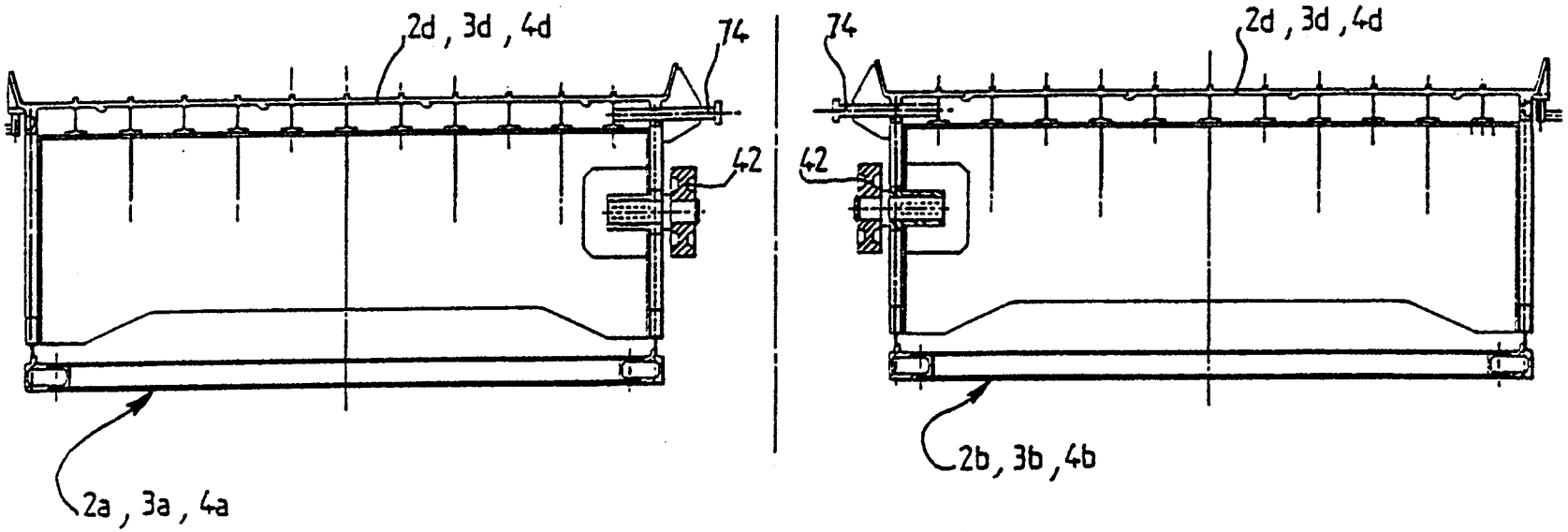
FIG. 16 is a view in section taken upon the line XVI—XVI of FIG. 6.
Figure 17:
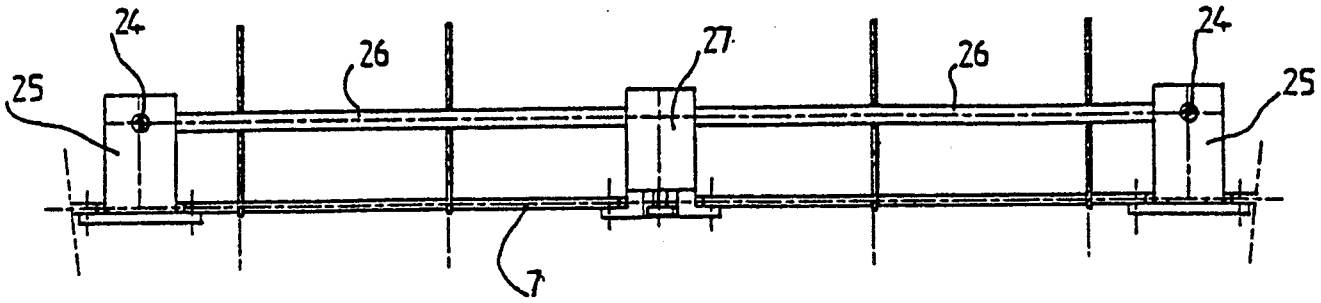
FIG. 17 illustrates a reducing mechanism forming part of the control means for locking the jaw-like elements and the locking bolts.
Figure 19:
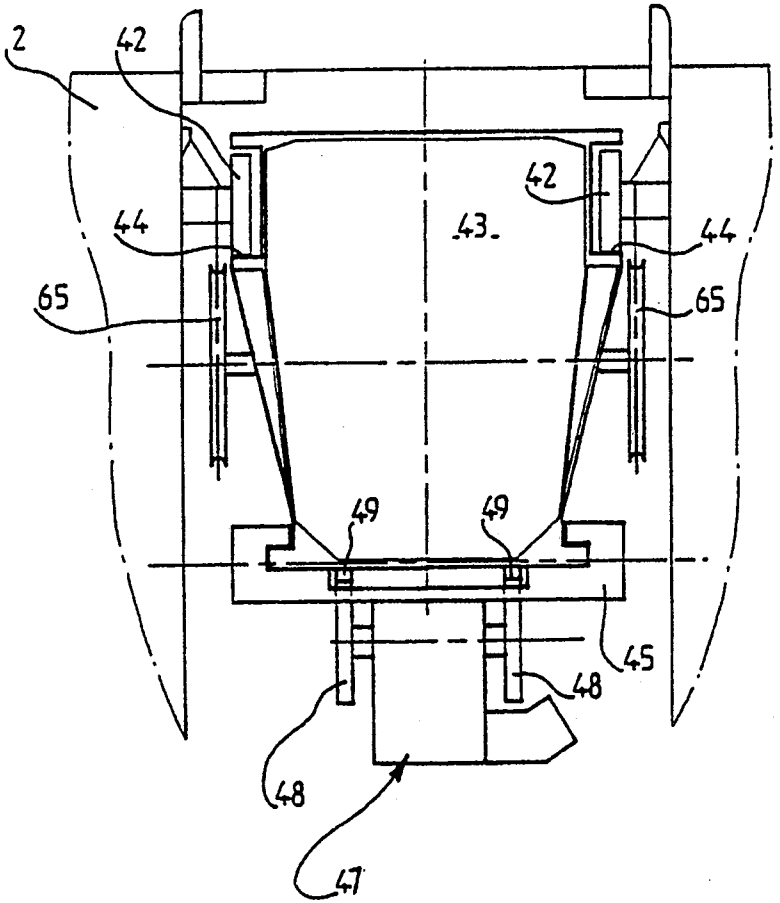
FIG. 19 is a view in section taken upon the line XIX—XIX of FIG. 1.
Figure 18:
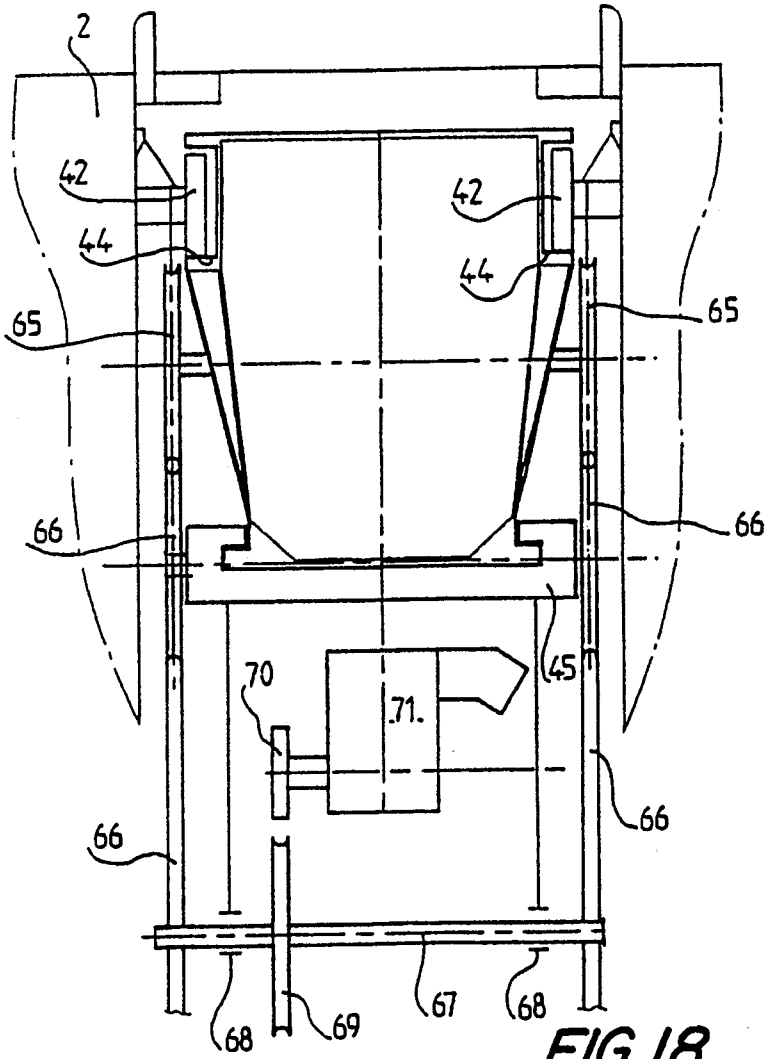
FIG. 18 is a view in section taken upon the line XVIII—XVIII of FIG. 1.
Figures 20, 21, 22:
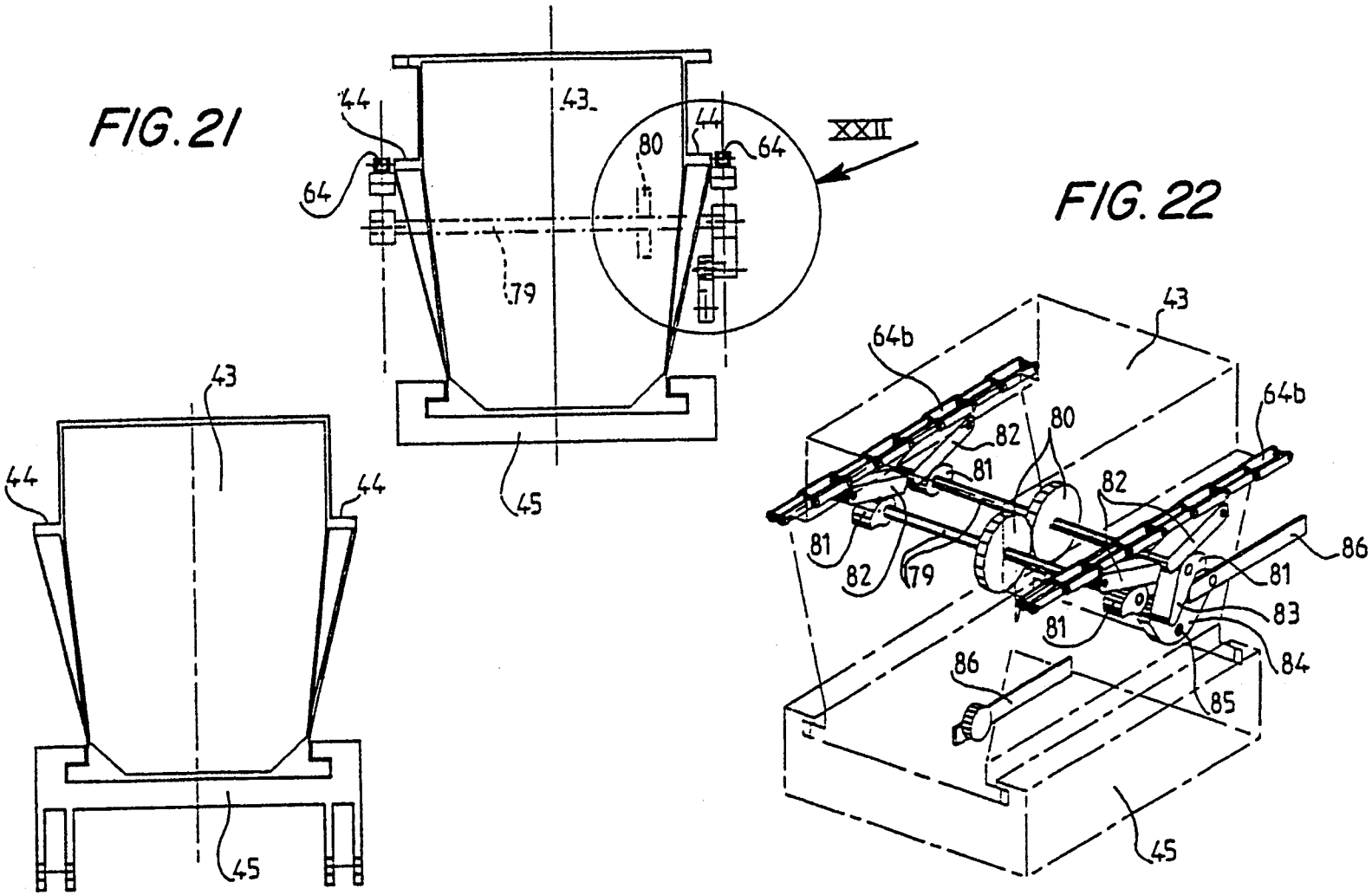
FIG. 20 is a view in section taken upon the line XX—XX of FIG. 1.
FIG. 21 is a view in section taken upon the line XXI—XXI of FIG. 1.
FIG. 22 is an enlarged perspective view of the portion circled at XXII of FIG. 21.
Figure 23:
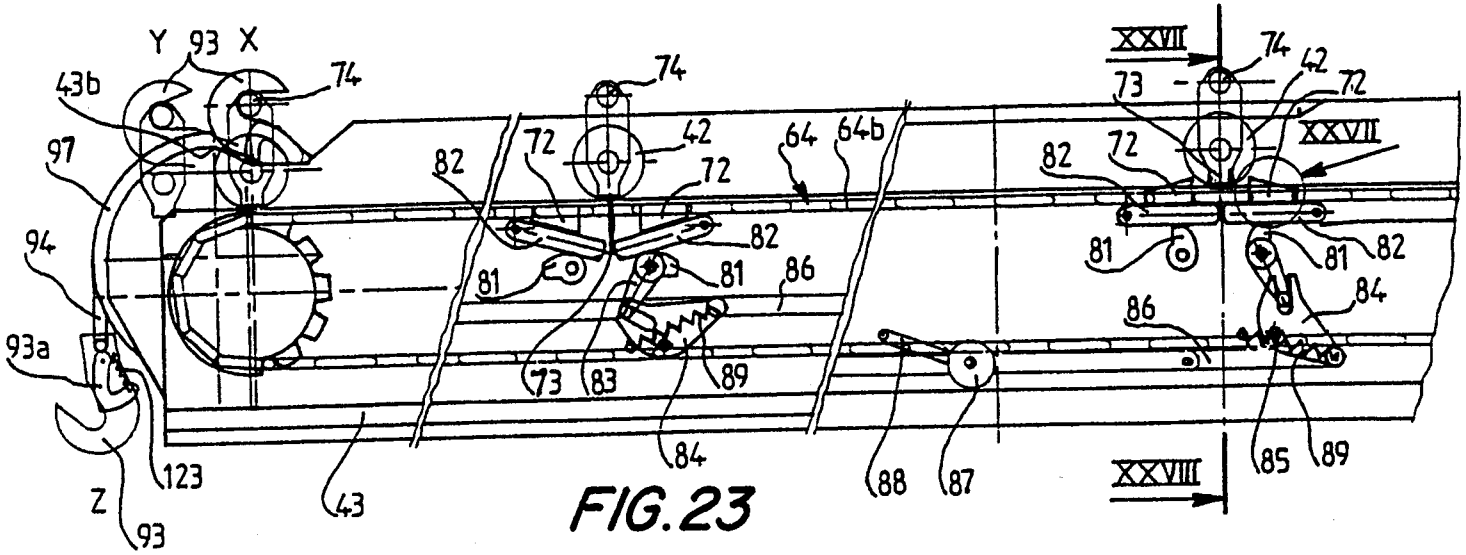
FIG. 23 is a partial longitudinal view of the girder forming part of the system according to the invention.
Figure 24:
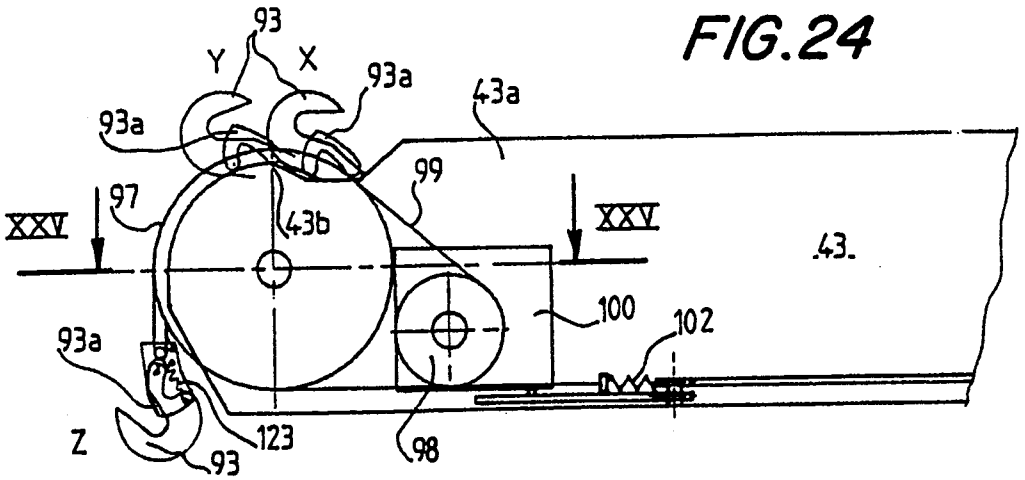
FIG. 24 is a view in longitudinal section of the end of the girder.
Figure 25:
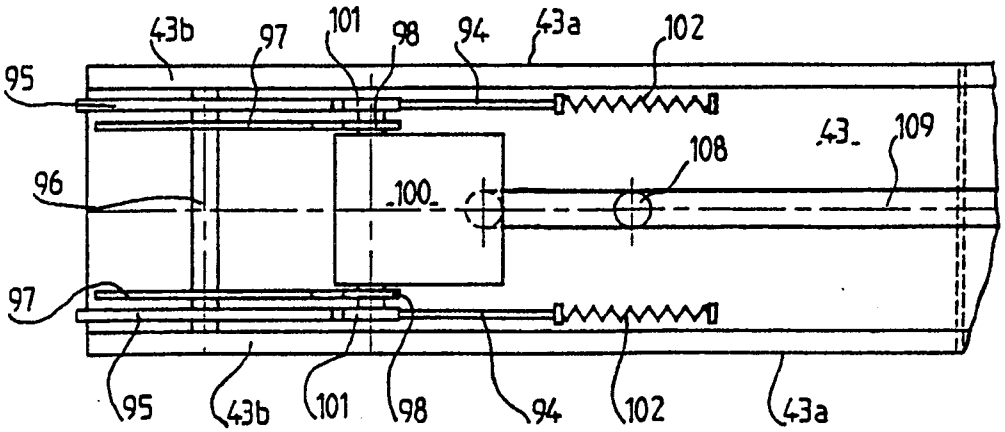
FIG. 25 is a view in section taken upon the line XXV—XXV of FIG. 24.

The access jib 9, opposite to the movable jib 8 of each spanning beam element is stationary and comprises at its upper part a transverse bar 35 adapted for the locking of one hook-shaped portion 36 at the end of an unlocked movable jib 8 of another spanning beam element. The bar 35 and the hook-shaped portion 36 are shaped so as to prevent the movable jib 8 from escaping the locking bar 35. The stationary access jib 9 moreover comprises at least one locking bolt 37, for instance twenty parallel locking bolts located in the plane forming the bottom of the spanning beam element while extending longitudinally so as to project from the end of the stationary jib 9. Each locking bolt 37 is identical with the locking bolts 11, 12 and therefore comprises a locking head 38 coming in front of a locking head 16 of a corresponding locking bolt 12 of the central box 7 when the spanning beam element comprising the locking bolts 37 is assembled end to end with the other spanning beam element comprising the locking bolts 12. Such an assembly of elements of spanning beams is shown in part on FIG. 11 which shows that the locking bolts 37 are made fast to the locking bolts 12 by both jaw-like members 13, 14. FIG. 8 illustrates two spanning beam elements assembled end to end wherein the movable jib 8 of the spanning beam element at the right with respect to this figure is resting upon the stationary jib 9 of the left spanning beam element while being locked by the hook-shaped end portion 36 at the locking bar 35 of the stationary access jib 9 with the locking bolts 37 of the stationary access jib 9 being locked to the locking bolts 12 of the central box of the right spanning beam element by both jaw-like members 13, 14. In the assembled positions of two spanning beam elements, the movable jib 8 provides for the continuities of the top trackways of both spanning beam elements. The stationary jib 9 of each spanning beam element also comprises two jacks 39 fastened in the jib 9 at right angles to the bottom thereof and adapted to lift the movable jib 8 of another spanning beam element for unlocking the hook-shaped portion 36 from the locking bar 35 of the stationary access jib 9. The rod of the jack 39 is fully retracted into the stationary access jib 9 in the rest position and its end is acting below the movable access jib 8 for unlocking it from the stationary access jib 9.

Both elements of a spanning beam are assembled by their connecting arms forming braces in such a manner that the spanning beam may have available at each one of its ends, two movable and stationary access jibs 8 and 9, respectively, so that the spanning beams may be coupled to each other irrespective of their direction of presentation to each other. Each access jib has of course the same width as that of the corresponding central box and in the configuration of the spanning beam laid down or deposited over a breach, the opposite retractable jibs thereof are locked at their lower part to their supporting central box.

Figure 7:
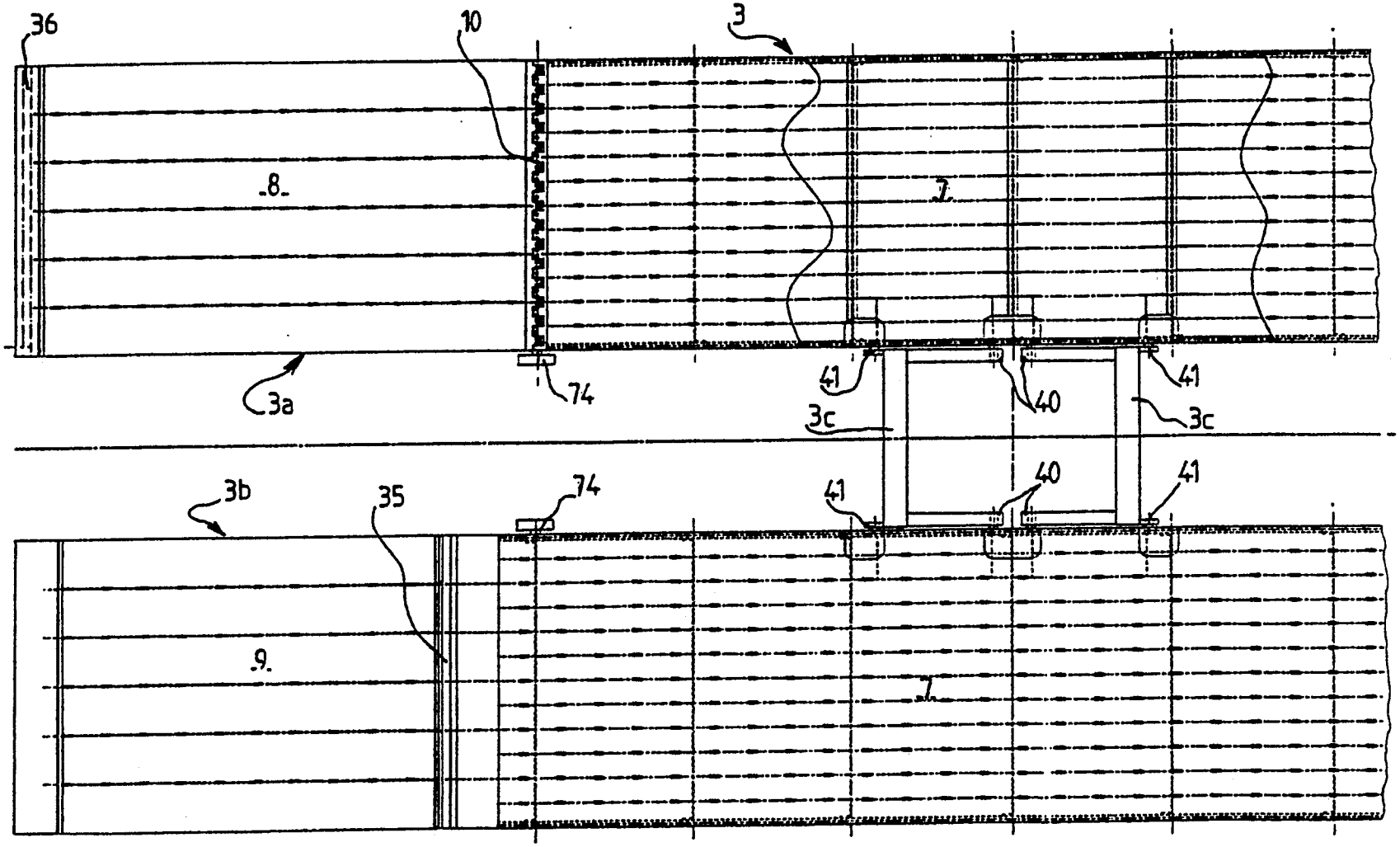
FIG. 7 is a top view according to the arrow VII of FIG. 6 of a central portion of the spanning beam.

As shown on FIG. 7, both connecting arms forming braces 3*c* of both elements 3*a*, 3*b* of the intermediate spanning beam 3 have each one the shape of a U the top ends of which are pivotally fastened by pins 40 to both central boxes 7 of both spanning beam elements so that they may swing about these pins between a lowered position between both spanning beam elements substantially perpendicular to the plane passing through the top trackways and an upwards swung or raised position substantially parallel to this plane. In the upwards swung or raised position both connecting arms 3*c* are automatically locked at the level of their bases to both boxes of both spanning beam elements by locking members 41 as explained further on.

Each spanning beam 2, 3, 4 moreover comprises two pairs of front and rear running rollers 42 fastened in confronting relationship to both internal side walls, which are confronting each other, of both spanning beam elements, respectively.

The system for depositing the spanning beams 2, 3, 4 comprises a longitudinal launching and depositing girder 43 extending in the rest or inoperative position substantially throughout the whole length of the vehicle 1 while being accommodated for a great part in a longitudinal space or room defined between two overlying upper and intermediate spanning beams 2 and 3 and the upper connecting arms 2*c* of the spanning beam 2 and the connecting arms 3*c* of the spanning beam 3 in the lowered position, the latter thus allowing to increase the height of housing of the girder 43 between the connecting arms. The girder 43 comprises at its upper portion two side shoulders 44 forming two rails for guiding rollers 42 for the travel of each one of the spanning beams. The girder 43 is supported while being guided therein in longitudinal translatory motion by a supporting plate 45 which is fastened in pivoting relationship to the frame of the vehicle by a transverse pivot pin 46 so as to be capable of tilting about this pivot axis in the counter-clockwise direction for depositing the spanning beams. The guiding of the girder 43 is performed by a lower T-shaped tenon of the girder 43 engaging a mortise of complementary mating shape of the supporting plate 45. The girder 43 is driven in relation to the supporting plate 45 by a motor-reducing gear set 47 fastened underneath the supporting plate 45 driving two drive pinions 48 meshing through the bottom of the support 45 with two parallel longitudinal toothed racks 49 fastened below the girder 43. The rocking or swinging of the supporting plate 45 is obtained by a control device 50 (see in particular FIGS. 30 to 32) comprising a motor-reducing gear set 51 fastened to the frame 5 at the rear of the vehicles and driving a cross-shaft 52 by a drive belt 53-pulley 54 mechanism made fast to the shaft 52 both ends of which are kinematically connected to a transverse rotary shaft 55 supporting two winch drums 56 on which are winding up two parallel cables 57 for tilting the supporting plate 44. The cables 57 comprise two parallel longitudinal portions 57*a* passing over two return pulleys 58, respectively, fastened to the frame 5 so as to define two substantially vertical cable portions 57*b* passing on two control pulleys 59 secured to two yokes 60 themselves fastened underneath the supporting plate 45. Both cables 57 are extending beyond the pulleys 59 with two substantially vertical cable portions 57*c* the ends of which are fastened to both ends, respectively, of a transverse bar 61 forming a swinging member with a longitudinal central shaft rotatably mounted in a clevis 62 made fast to the frame 5. The shafts 52 and 55 are rotatably mounted in a yoke-shaped support 63 and the rotary driving of the shaft 55 by the shaft 52 may be carried out for instance by a system of pulleys secured to the ends of the shafts 52, 55 and two drive belts reeved on these pulleys. The tilting of the supporting plate 45 takes place when a spanning beam or at least two spanning beams assembled end to end are in a cantilever or overhang position with respect to this plate so as to exert a force tending to naturally rock the latter. In such a situation it then suffices to put the motor-reducing gear set 51 into operation so that the drums 56 be rotated in the direction of paying out or unwinding of the cables 57.

Figure 27:
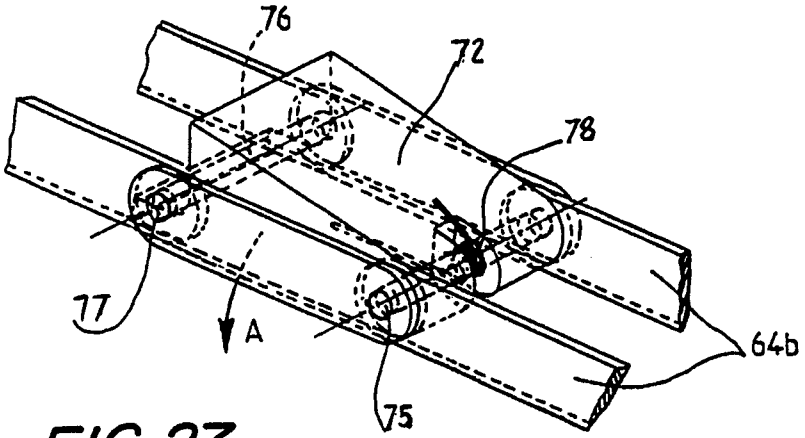
FIG. 27 is an enlarged view in section taken upon the line XXVII—XXVII of FIG. 23.
Figure 29:
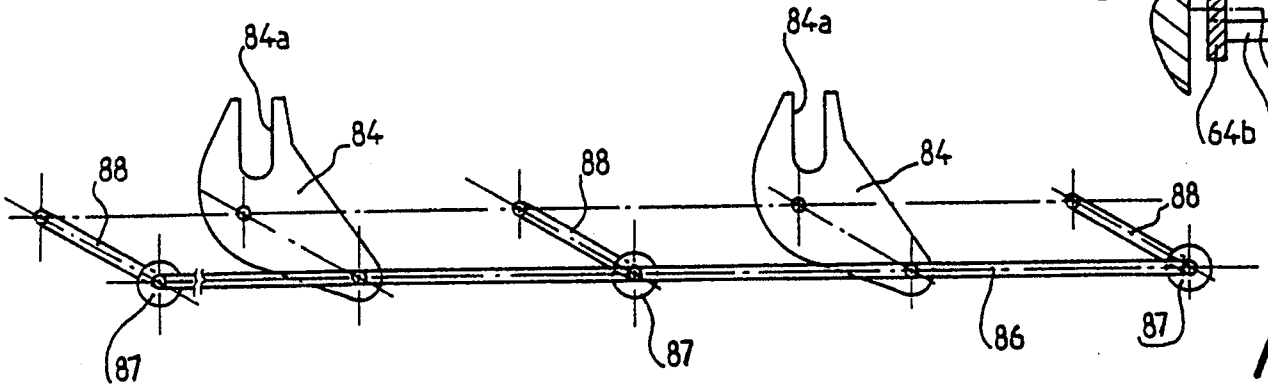
FIG. 29 is a diagrammatic view showing a rod and rollers for operating the locking or the unlocking of the fork-like elements.
Figure 31:
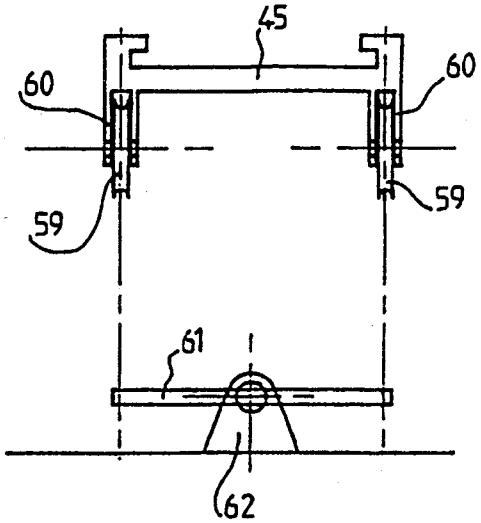
FIG. 31 is a view seen in the direction of the arrow XXXI of FIG. 30.
Figure 30:
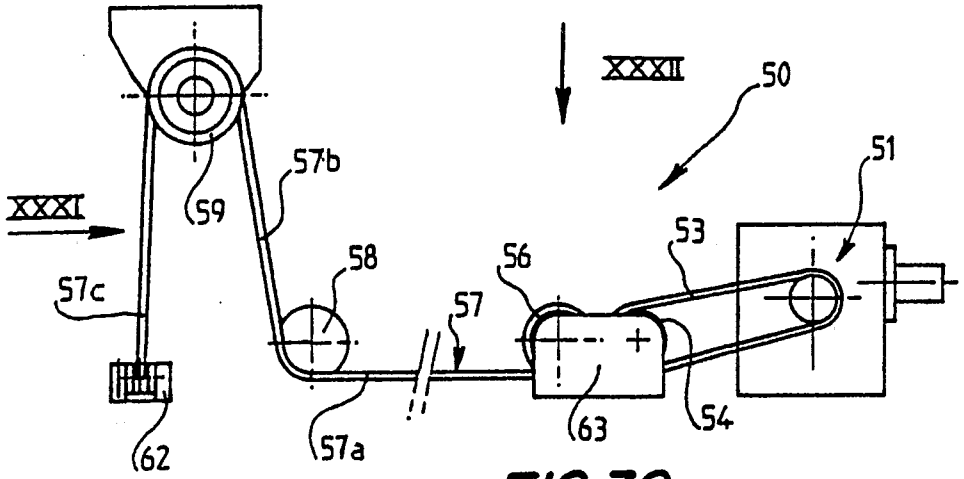
FIG. 30 shows a device for controlling the rocking of the girder-supporting plate.
Figure 32:
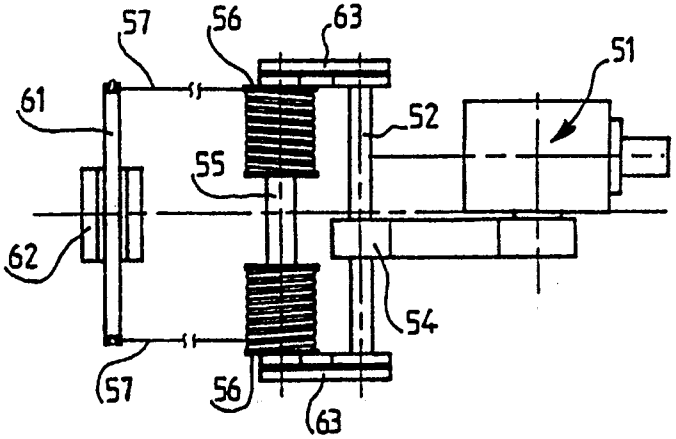
FIG. 32 is a top view according to the arrow XXXII of FIG. 30.
Figure 35:
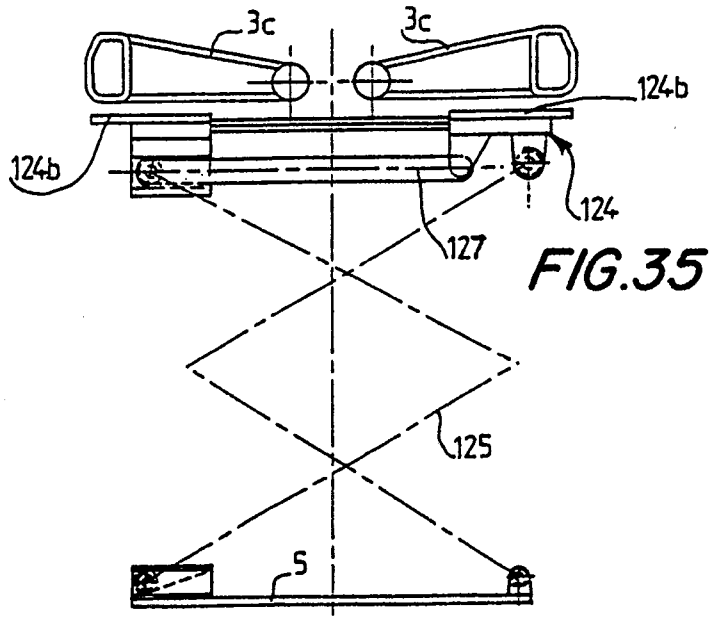
FIG. 35 is a view like FIG. 33 with the lifting table in the upper position.
Figure 36:
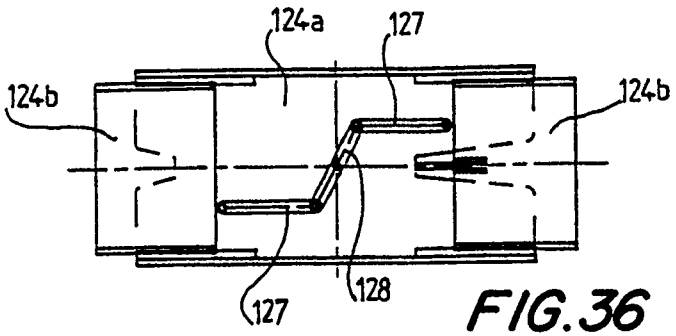
FIG. 36 is a view according to the arrow XXXVI of FIG. 35.
Figure 33:
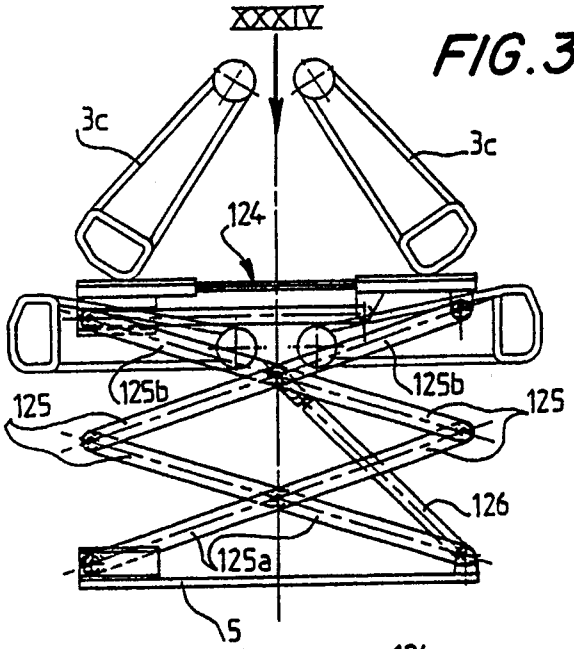
FIG. 33 shows a table for lifting the connecting arms of two spanning beam elements.
Figure 34:
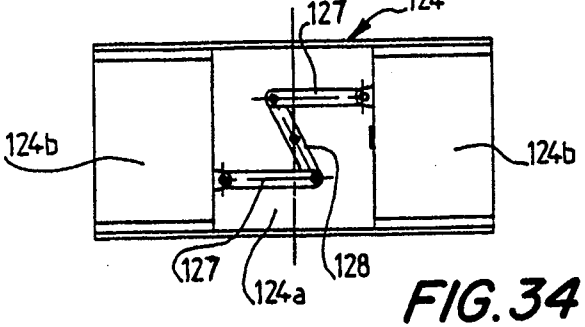
FIG. 34 is a top view according to the arrow XXXIV of FIG. 33.

The system moreover comprises means for displacing one spanning beam or two spanning beams assembled end to end in relation to the supporting girder 43. These means comprise two endless drive chains 64 arranged on either side of the girder 43 in symmetrical relation to the latter and each one mounted on two toothed wheels 65 fastened to both ends of the girder 43 with the lower side 64*a* of each chain 64 passing over three toothed guide wheels 66 arranged in a triangular configuration and rotatably mounted on the supporting plate 45. More specifically both toothed wheels 66 of a same side of the beam forming the base of the triangle are mounted for free rotation on a transverse support shaft projecting from the supporting plate 45 whereas the lower toothed pinion 66 forming the apex of this triangle is bound in rotation to a transverse shaft 67 rotatably mounted on support bearings 68 made fast to the supporting plate 45. The shaft 67 comprises a pulley 69 rotated by a drive pulley 70 connected to the pulley 69 by a belt (not shown) and made fast to the end of an output shaft of a motor-reducing gear set 71 made fast to the supporting plate 45. Thus the motor-reducing gear set 71 would simultaneously drive both lower toothed guide wheels 66 located on either side of the girder 43. The means for displacing the spanning beams in relation to the girder 43 also comprise two front pairs of retractable fork-shaped elements 72 made fast to both upper sides 64*b*, respectively, of both drive chains 64 and two rear pairs of retractable fork-like elements 72 also made fast to both upper sides 64*b*, respectively, of both chains 64. Both front pairs of fork-like elements 72 are adapted to grip two projecting finger-shaped portions 73 made fast to two spanning beam elements, respectively, and located plumb with two rollers 42 above which are located in a same vertical plane two forward handling shafts 74 arranged in confronting relationship with each other. Likewise both rear pairs of fork-shaped elements 72 are adapted to grip two projecting finger-like portions 73, respectively, made fast to two spanning beam elements, respectively, rearwards of the latter, plumb with two running rollers 42 above which are respectively located two back handling shafts 74 arranged in confronting relationship with each other. Both pairs of fork-like elements 72 are simultaneously brought in the position of gripping the fingers 73 or in a retracted position by a mechanical mechanism operated by a control device fastened to the supporting plate 45. Each pair of fork-like elements consists of two brackets or blocks mounted in pivoting confronting relationship on two parallel pins, respectively, of links of a drive chain 64. FIG. 27 shows one of the two brackets or blocks 72 swingably mounted at one of its ends onto a pin 75 for the connection of parallel links of the chain 64 and having its opposite end comprising a lower heel-like portion 76 caused to bear in the position of gripping the bracket 72 below the pin 77 for the connection of the links of the chain 64 adjacent to the pin 75. Thus each bracket or block 72 is movable between two parallel links of the chain 64. Advantageously a spiral spring 78 is provided on the pin 75 so as to urge each bracket 72 into the retracted position as shown by the arrow A. The aforesaid mechanical mechanism comprises two transverse shafts 79 rotatably mounted in the girder 43 and rotated together by two toothed wheels 80 meshing with each other and made fast to both shafts 79, respectively. At the end of each one of the two shafts 79 are fastened cams 81 located outside of the girder 43 and each one arranged underneath an arm 82 pivotally mounted at one of its ends on the girder 43. Each pivoting arm 82 is arranged below a bracket 72 so as to lift the bracket 72 to a position of gripping a finger 73 projecting above the plane passing through the upper sides **64*b* of the chains 64 under the action of the corresponding cam 81. One of the four cams 81 associated with both front and rear pairs of fork-like elements 72 is extended by an arm 83 the end of which pivotally engages a notch 84*a* of a plate 84 pivotally mounted about a shaft 85 on the girder 43. The plate 84 forms in a way a lever having one arm-like portion acting upon the arm 83 and another lever arm-like portion the end of which is pivotally connected to a control rod 86 extending longitudinally of the beam 43. The rod 46 is also pivotally connected to the end of the other plate-shaped lever 84 associated with both other pairs of fork-like elements 72. Three control rollers 87 are fastened to the free ends, respectively, of three arms 88 pivotally fastened to the girder 43, these free ends being also connected pivotally to the rod 86. Thus the assembly consisting of the plates 84, the rod 86 and the arms 88 forms a deformable parallelogram so as to cause both plates 84 located on one single side of the girder 43 to simultaneously tilt from the position of retracting the brackets 72 shown at the left on FIG. 23 to the position of gripping the brackets 72 by the drive fingers 73, shown at the right of this figure. With each plate 84 is associated a spring 89 having one of its ends fastened to the girder 43 and its end opposite to the pivot point of the plate 84 fastened to the rod 86 so as to keep each plate 84 in both end positions of retracting and gripping the brackets 72, respectively. The device for controlling the mechanism for displacing the brackets 72 comprises an element such as a vertical plate 90 fastened to the supporting plate 45 and vertically movable between a lower position and an upper position so as to act upon the rollers 87 and thus cause the desired tilting of the plate 84 to the retracted position or to the position of gripping the brackets 72. More specifically the plate 90 is arranged in the same vertical plane as the rollers 87 and has its two ends shaped as isosceles triangles the vertices of which are longitudinally aligned. Thus in the lower position of the plate 90, the upper side of either one of the triangles is acting to push one of the rollers 87 upwards and therefore to retract the brackets 72 whereas in the upper position of the plate 90, the lower side of either one of the triangles is acting to push one of the rollers 87 downwards and therefore to bring the brackets 72 into the position of gripping the fingers 73. The vertical displacement of the plate 90 is provided by two parallel arms 91 pivotally connected with their ends to the plate 90 and to the supporting plate 45 and a jack 92 with a double rod having their ends pivotally connected to the point of pivotal connection of one of the arms 91 to the supporting plate 45 and to the point of pivotal connection of the other arm 91 to the plate 90**, respectively.

Figure 26:
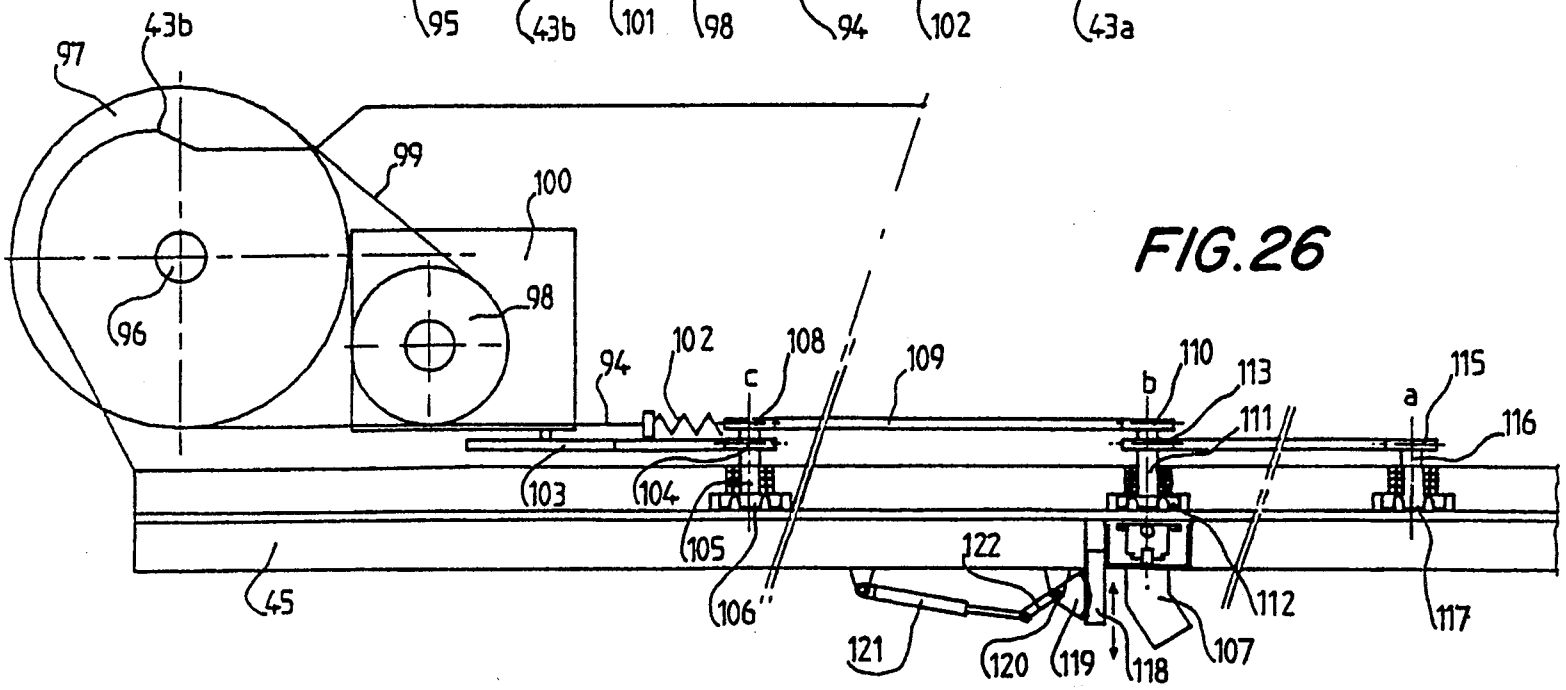
FIG. 26 is an enlarged view of FIG. 24 showing three different positions which the girder may assume in relation to a tilting support plate of the vehicle.
Figure 28:
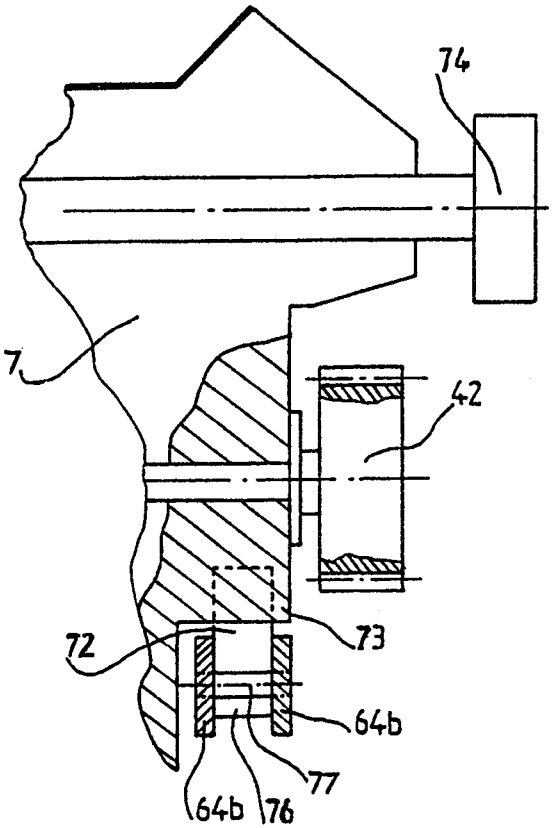
FIG. 28 is a view in section taken upon the line XXVIII—XXVIII of FIG. 23.

The system also comprises two operated hooks 93 for looking both confronting handling shafts 74, respectively, of both spanning beam elements of a spanning beam and fastened to the ends of two drive chains 94 arranged in symmetrical relation to the longitudinal center line axis of the girder 43 and passing over two parallel toothed wheels 95, respectively, rotatably mounted at the end of the girder 43 while being perpendicular with respect to the bottom of the latter. Both toothed wheels 95 are bound in rotation to a transverse shaft 96 rotatably mounted between two side walls **43*a* of the girder 43. Two pulleys 97 parallel to the toothed wheels 95 are also bound in rotation to the shaft 96 and driven by two drive pulleys 98 kinematically connected to the pulleys 97 by two belts 99. Both drive pulleys 98 are each one made fast to an output shaft of a reducing mechanism 100 fastened to the girder 43. Each control chain 94 passes below a toothed guide pinion 101 mounted for free rotation at the end of the corresponding output shaft of the reducing mechanism 100 and has its free end connected to the end of one compensation spring 102 having its opposite end fastened to the bottom of the girder 43. The input shaft of the reducing mechanism 100 is driven by a first reducing mechanism with pulleys 103, 104 kinematically connected by a belt (not referred to), the shaft 105 driving the pinion 104 extending through the bottom of the girder 43 and having at its lower end a rotary coupling plate 106 capable of being driven by a hydraulic motor 107 as will be explained hereinafter. The drive shaft 104 also drives an upper pulley 108 of the same diameter as the diameter of the pulley 104 kinematically connected by a drive belt 109 to a pulley 110 made fast to the end of a rotary shaft 111 having its lower end made fast to a rotary coupling plate 112 like the plate 106. The shaft 111 drives a second pulley 113 like the pulley 110 coupled by a belt 114 to a pulley 115 made fast to a rotary drive shaft 116 extending through the bottom of the girder 43 and the lower end of which is made fast to a rotary coupling plate 117 identical with the plates 106 and 112. As shown on FIG. 26, the girder 43 may assume with respect to the motor 107 fastened underneath the supporting plate 45 three distinct stationary positions a, b, c at each one of which the motor 107 is removably coupled to the corresponding plates 106, 112 and 117. At each one of the positions a, b, c, one of the rollers 87 is lying in the plane of the plate 90 in order that the latter may lock or unlock the fingers 73 to or from the fork-like elements 72. FIG. 26 shows the plate 112 for driving the shaft 113 ready to be coupled for rotation to an output plate of the motor 107. The output plate of the motor 107 is of the type comprising fingers or claws engaging cavities of shapes complementary of or mating with that of the plate 106, 112 or 117. This output plate is mechanically coupled to a bar with a toothed rack 118 axially guided in a direction transverse to the supporting plate 45 and meshing with a toothed segment 119 rotated about a shaft 120 fastened to the plate 45 by a control jack 121 and a lever arm 122. The shaft with the toothed rack 118 is shown in inoperative position of disengagement of the output plate of the motor 107 from the coupling plate 112**.

Each hook 93 comprises a latch 93*a* for locking one handling shaft 74 constantly urged back into unlocking position by a spring 123. As shown on FIGS. 23 and 24, both hooks 93 may assume three positions X, Y and Z. In the position Z of depositing spanning beams, both handling shafts 74 are accommodated within both hooks 93, respectively, without being locked by the latches 93*a*. Each end of the side wall 43*a* of the girder 43 has a flange 43*b* shaped as a cam co-operating with the end of the latch 93*a* of the hook 93 in the same plane as the side wall 43*a* so as to bring the latch 93*a* into the position of unlocking a handling shaft 74 when the hook 93 is in the position X and this under the biassing action of the spring 123. In the position Y, the latch 93*a* of each hook 93 assumes the position of locking a handling shaft 74 since the flange 43*a* is acting as a cam pushing the latch 93*a* against the return force of the spring 123.

FIGS. 33 to 36 show the device for raising both connecting arms 3*c* of the intermediate spanning beam 3. This device comprises a raising table 124 assuming in the position of conveyance of the spanning beams, the lowered position shown on FIG. 33 in which the ends of both connecting arms 3*c* are resting upon the table 124. The latter is fastened to the frame 5 of the vehicle through the medium of pivotally connected arms 125 perpendicular to the frame 5 and defining a parallelogram deformable under the action of a jack-like member 126. More specifically both lower arms of the deformable parallelogram are extended by portions 125*a* fastened pivotally to the frame 5 whereas the upper arms of these parallelograms are extended by portions 125*b* pivotally fastened below the table 124. The table 124 consists of a frame 124*a* supporting for sliding motion along the longitudinal center line axis of the vehicle two small tables 124*b* connected to each other by two parallel arms 127 pivotally connected on the one hand to both small tables 124*b* and on the other hand to both ends of a central lever 128 pivotally mounted at its center about a pin perpendicular to the frame 5 of the vehicle. The arms 127 and the lever 128 allow both small tables 124*b* to move away from each other as the table 124 is raised so that the ends of the connecting arms 3*c* be constantly bearing upon both small tables 124*b* until they reach their raised position parallel to the frame 5 of the vehicle. In the upper position of the lifting table 124, the connecting arms 3*c* are locked to the spanning beam elements by locking members 41. Such members may consist of a hook pivotally mounted on the corresponding spanning beam element and operated by a jack mounted on a small table 124*b* so as to rock the hook into the position of locking a looking pin made fast to the corresponding connecting arm 3*c*.

The system also comprises a casing 129 located in the longitudinal center line axis of the vehicle at the rear of the latter and usable as a support for the back end of the girder 43 in the transport position of the spanning beams and a jack 103 mounted on the frame 5 of the vehicle just rearwards of the cabin 6 along the longitudinal center line axis of the vehicle and adapted in particular to lift the girder-upper spanning beam assembly at the beginning of the launch of the upper spanning beam.

The system at last comprises a device forming an antirocking foot of the vehicle located forward thereof and comprising a plate 131 pivotally connected to both free ends of two jack rods 132 pivotally connected to the frame of the vehicle and capable of being folded back into an inoperative position stowed within the vehicle as shown on FIG. 1 and two pairs of jacks 133 fastened to the frame 5 of the vehicle in symmetrical relation to the longitudinal center line axis of the latter so as to lift the spanning beams above the frame 5.

The principle of depositing three spanning beams assembled end to end which already appears in part from the above description of the system will be set forth in detail with reference to FIGS. 37A to 37P.

Figures 37A, 37B, 37C, 37D, 37E, 37F:
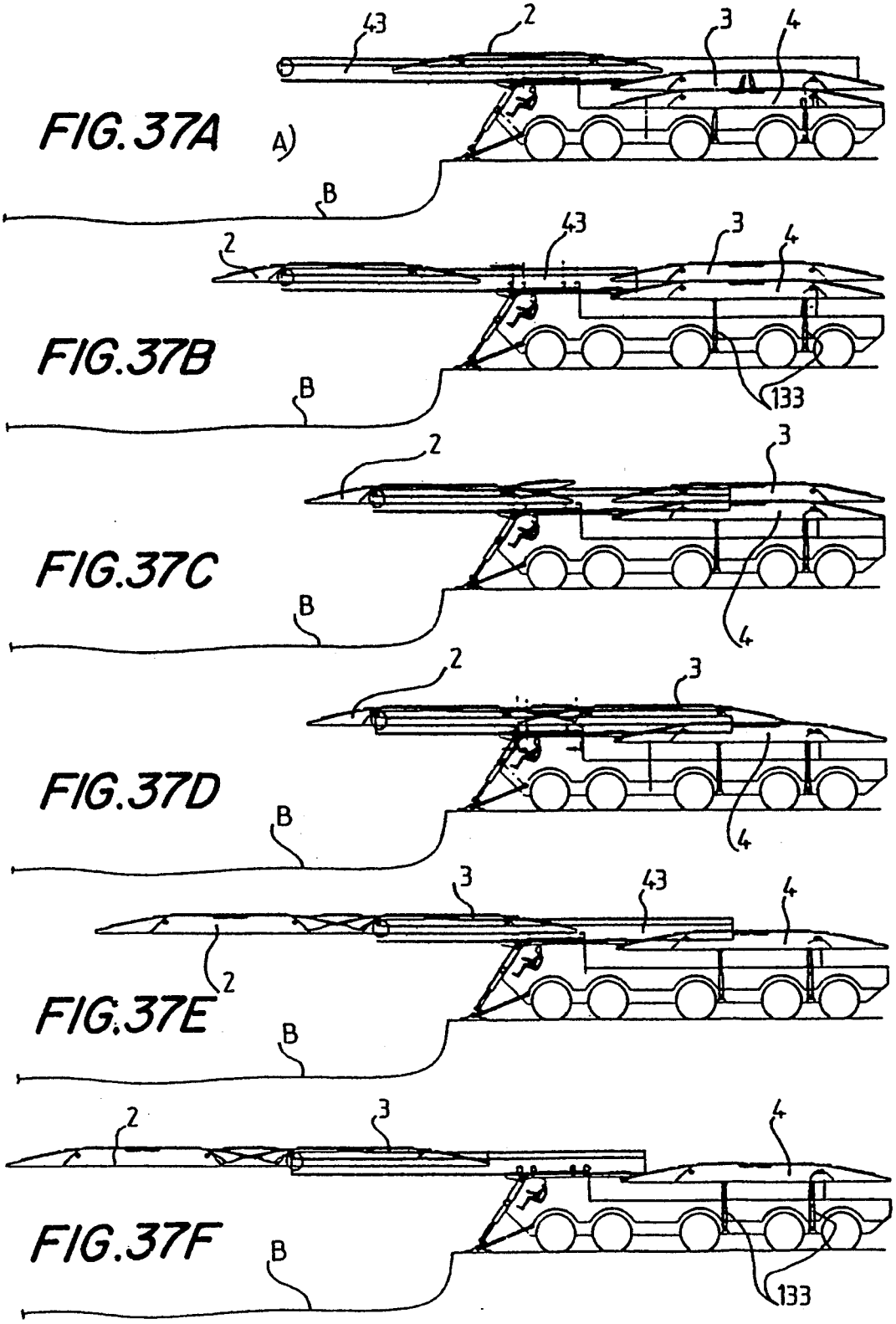
FIGS. 37A to 37P show the various steps of assembling three spanning beams to form a spanning beam of greater length and for depositing the latter above a breach to be cleared.

The vehicle 1 conveys the three overlying spanning beams to the place where the breach B to be cleared is located and is approaching the latter until reaching the location shown on FIG. 37A. In the initial conditions, the upper spanning beam 2 is connected to both chains 64 by the fork-like elements 72 enclosing the finger-shaped portions 73 of the upper spanning beam elements 2. The vehicle 1 is thus located in front of the breach in the transport position shown on FIG. 1. The device forming the anti-rocking foot is extended so that the plate 131 bears upon the ground and the jack 130 is activated for slightly lifting the girder 43-upper spanning beam 2 assembly from the supporting box 122 so as to release the upper spanning beam from the intermediate spanning beam 3. The motor-reducing gear set 47 is activated so as to displace in relation to the supporting plate 45 the unitary assembly formed of the girder 43 and of the upper spanning beam 2 to the most overhanging position of the girder forward of the vehicle, in which position the hydraulic motor 107 has its output shaft mechanically coupled to the plate 117 driving the shaft 116 supporting the pulley 115. The system is thus in the position shown on FIG. 37A. As shown on FIG. 37B the upper spanning beam 2 is longitudinally displaced on the girder 43 by energizing the motor-reducing gear set 71 driving both drive chains 64. The transfer of the spanning beam 2 is effected until both front handling shafts 74 of the spanning beam Z are engaging both hooks 93, respectively, in the position X which are brought into the position Y of locking the handling shafts 74 by the motor-reducing gear set 100 energized by the hydraulic motor 107 at the same time as the upper spanning beam 2 is advanced over a small distance forwards with respect to the girder 43. Then the jack 126 controlling the table 124 is actuated so that the table 124 lifts both connecting arms 3*c* of the intermediate spanning beam 3 up to their position of locking to the corresponding spanning beam elements, in which they are locked. Once the table 124 has again been lowered into inoperative position, both pairs of side jacks 133 are energized so as to lift both overlying intermediate and lower spanning beams 3 and 4 until the intermediate spanning beam 3 be substantially on the same level as the upper spanning beam 2 and the fork-like elements 72 are brought into the inoperative retracted position by deforming the deformable parallelogram consisting of the plates 84, the rod 86 and the arms 88 by the plate 90 acting upon the corresponding roller 87. The motor 107 is disengaged from the plate 117 driving the shaft 116.

As shown on FIG. 37C, the girder 43 and the upper spanning beam 2 which is connected thereto by the hooks 93 are displaced in relation to the supporting plate 45 rearwards to the position wherein the motor 107 is coupled to the plate 112 driving the shaft 111 with the back portion of the girder 43 inserting itself between both intermediate and lower spanning beams 3 and 4. In this position the plate 90 is lowered to lock the hook-like elements 72 to both finger-shaped front portions 73, respectively, of the intermediate spanning beam 3. The motor-reducing gear set 71 is energized so that the drive chains 64 are displacing the intermediate spanning beam 3 towards the rear end of the upper spanning beam 2. Initially the raisable rear access jib of the spanning beam 2 and the raisable front access jib of the spanning beam 3 are unlocked. While the intermediate spanning beam 3 is moving towards the upper spanning beam 2, the jacks 39 for lifting the access jibs are energized for lifting the raisable access jibs 8. The access jib 8 of the upper spanning beam 2 engages with its end over the corresponding stationary jib 9 of the intermediate spanning beam 3 whereas the jib 8 of the intermediate spanning beam 3 engages with its end upon the stationary jib of the upper spanning beam 2 and the hook-like portions 36 of the liftable jibs 8 are engaging transverse bars 35, respectively, of the stationary jibs 9. Simultaneously the locking shafts 37 of the stationary jibs 39 are locked to the locking shafts 12 by jaw-like members 13 by rotating through the corresponding hydraulic motor (not shown) and the guiding mechanisms 24, 27 the control rods 24 about their longitudinal center line axes. This hydraulic motor is fastened underneath the supporting plate 45 and is removably coupled to the guiding mechanism 27 in the same manner as the motor 107. The hydraulic motor for operating the jaw-like members 13 is then withdrawn from the guiding mechanism 27 and both assembled spanning beams 2, 3 are withdrawn from the hooks 93 by moving back through the drive chains 64 both assembled spanning beams and by simultaneously bringing both hooks 93 from the state Y to the state X for unlocking and disengaging the hooks 93 from both front handling shafts 74 of the upper spanning beam 2. The hooks 93 are then brought into the position Z. FIG. 37D shows both spanning beams 2, 3 assembled end to end.

As shown on FIG. 37E, the assembled spanning beams 2, 3 are displaced in relation to the girder 43 by the drive chains 64 into an overhang position in relation to the girder 43 such that the front handling shafts 74 of the intermediate spanning beam 3 are inserted into the hooks 73 brought from the position Z to the position X and the spanning beams 2, 3 are moved forwards with respect to the girder 43 with a concurrent displacement of the hooks 93 from the position X to the position Y for their locking the handling shafts 74 of the intermediate spanning beam 3. Then the fork-like elements 72 are brought into the retracted position so as to disconnect the fingers 73 of the intermediate spanning beam from the drive chains 94 and the motor 107 is disconnected from the plate 112 driving the shaft 111.

Figures 37G, 37H, 37I, 37J:
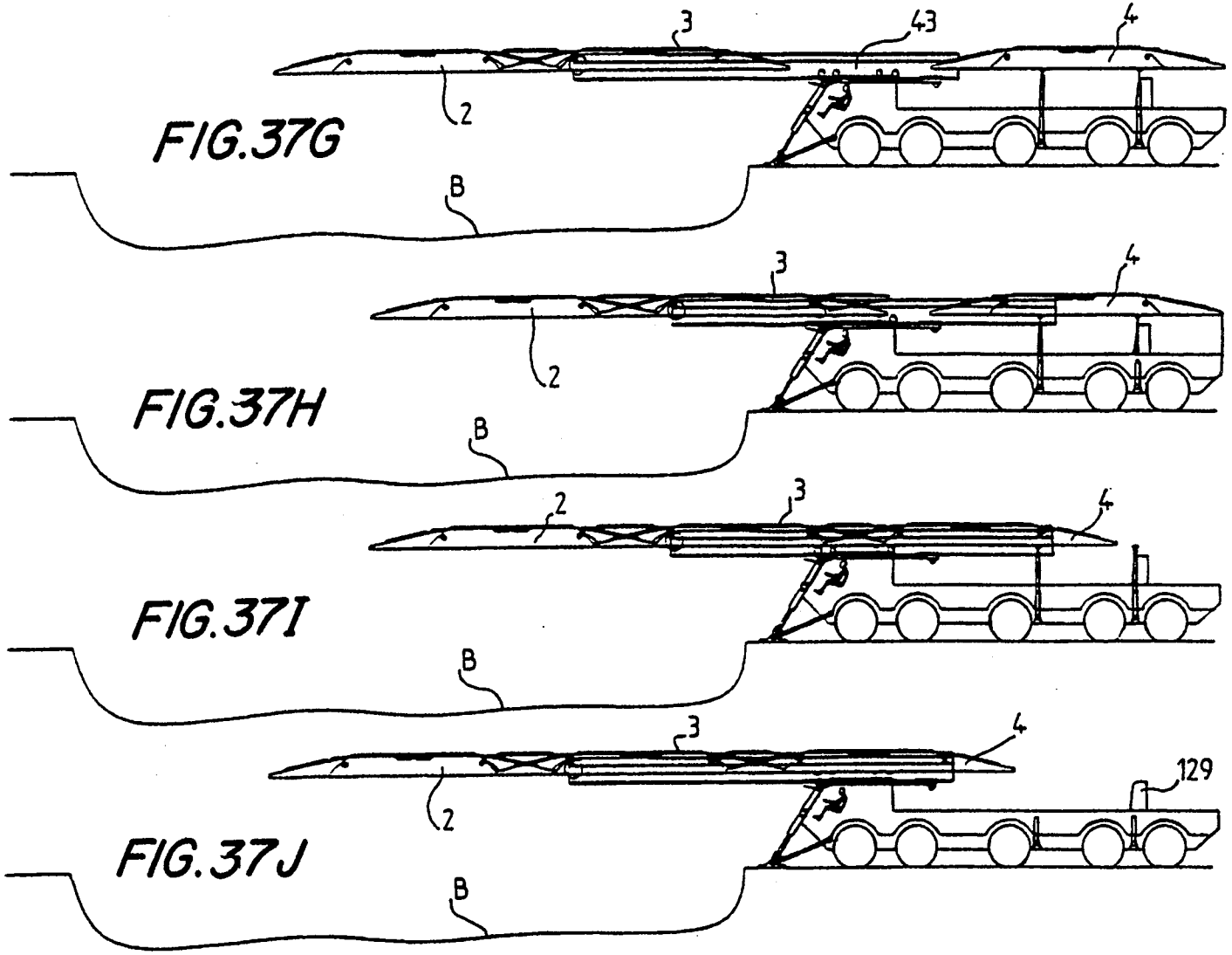

In order to disengage the rear portion of the girder 43 from the lower spanning beam 4, the girder 43 together with the assembled spanning beams 2, 3 is brought into its most overhanging position forward of the vehicle as shown on FIG. 37F. Then the side jacks 133 are operated so as to lift the upper spanning beam 4 substantially to the same level as the assembled spanning beams 2, 3 (FIG. 37G). FIG. 37H shows that the girder 43 at the same time as the assembled spanning beams 2, 3 has been moved backwards in relation to the supporting plate 45 into the position wherein the motor 107 is again coupled to the plate 112 driving the shaft 111. In this position the fork-like elements 72 are brought plumb with the finger-like front parts 73 of the lower spanning beam 4 and are brought by the plate 90 into the operative position of gripping the finger-like parts 73. The drive chains 64 are controlled so as to move the lower spanning beam 4 backwards of the intermediate spanning beam 3 and the jacks 39 for lifting the movable jibs 8 are energized to allow the endwise assembly of the lower spanning beam 4 to the intermediate spanning beam 3 in the same manner as for the endwise assembly of the spanning beams 2 and 3 as previously explained, it being understood that initially the movable jibs 8 of the intermediate and lower spanning beams, respectively, are unlocked. Once the spanning beams have been assembled as shown on FIG. 37I, the lifting jacks 39 are brought into the inoperative position, the motor controlling the jaw-like members 13 is disengaged from the reducing mechanism 27, the jacks 133 for lifting the spanning beams are brought into an inoperative position and the motor 107 is withdrawn from the plate 112 driving the shaft 111.

Figure 37K:
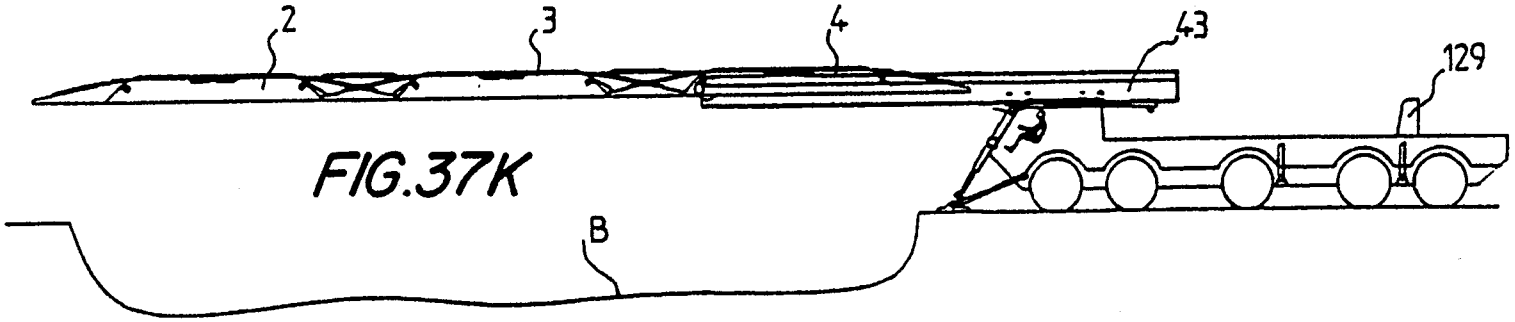

As shown on FIG. 37J, the girder 43 is moved to the most overhanging position forward of the supporting plate 45 and the motor 107 is coupled to the plate 117 driving the shaft 116. The spanning beams 2, 3, 4 are moved backwards with respect to the girder 43 by the drive chains 64 with the simultaneous displacement of the hooks 93 from the position Y to the position X for disengaging the handling shafts 74 from the intermediate spanning beam 3, the hooks 93 being then brought into the position Z. FIG. 37K shows that the assembled spanning beams 2, 3, 4 are moved in relation to the girder 43 by the drive chains 64 to an overhanging position wherein the front handling shafts 74 of the lower spanning beam 4 are locked within the hooks 93 in the manner already previously described. Then the fork-like elements 72 connecting the lower spanning beam 4 to the drive chains 64 are brought into the retracted position by the plate 90 and these fork-like elements 72 are brought plumb with the rear finger-like parts 73 of the lower spanning beam 4 for gripping the latter. Once the lower spanning beam 4 has been disconnected from the drive chains 64, the assembled spanning beams 2, 3, 4 are moved rearwards with respect to the girder 43 by the drive chains 64 with a simultaneous displacement of the hooks from the position Y to the position X for disengaging the handling shafts 74 of the lower spanning beam from the hooks 93 which are retained in the position X.

Figure 37L:
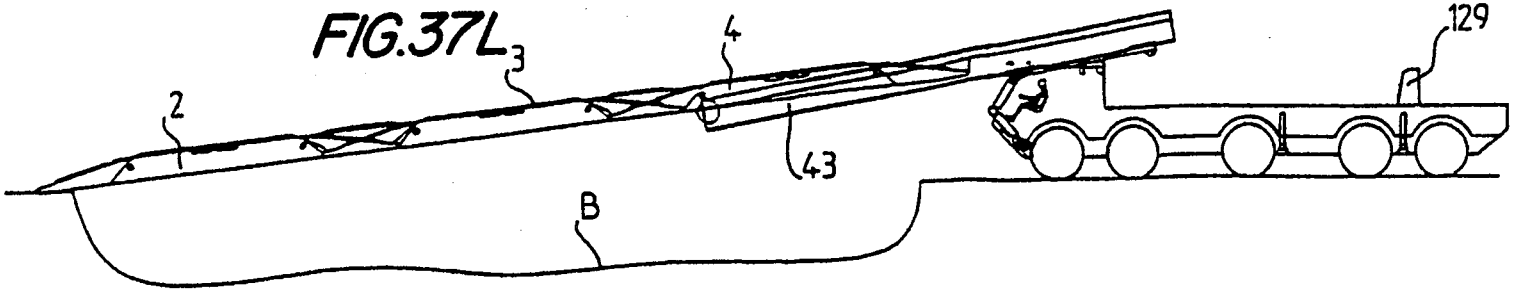

The motor-reducing gear set 51 is put into operation so as to drive the drums 56 in the direction of paying out or unwinding the cables 57 thereby causing the tilting of the supporting plate 45 and therefore of the girder 43-spanning beams 2, 3, 4 assembly so as to lay the end of the upper spanning beam 2 down upon the bank opposite to the vehicle. As shown on FIG. 37L, the whole of the spanning beams is disengaged from the girder 43 so as to form an angle of the spanning beams with respect to the girder of about 3°. The motor 107 is then disengaged from the plate 112 driving the shaft 111.

The girder 43 is then moved backwards with respect to the supporting plate 45 to a relative position such that the motor 107 may be coupled to the plate 106 driving the shaft 104 and at the same time the spanning beams are displaced with respect to the girder 43 by the drive chains 64 travelling in a translatory motion over the toothed wheels 65, 66 to a position such that the rear handling shafts 72 of the lower spanning beam 4 are engaging and locking themselves into the hooks 93 successively at the positions X and Y, the hooks 93 being then brought to the position Z. The rear finger-like parts 73 of the lower spanning beam 4 are automatically disengaging from the fork-like elements 72 when the hooks 93 are in the position Y as this besides is shown on FIG. 23. The drive chains 64 are operated so as to bring the fork-like elements 72, being still in the operative gripping position, back to their initial position of FIG. 37A.

Figure 37M:
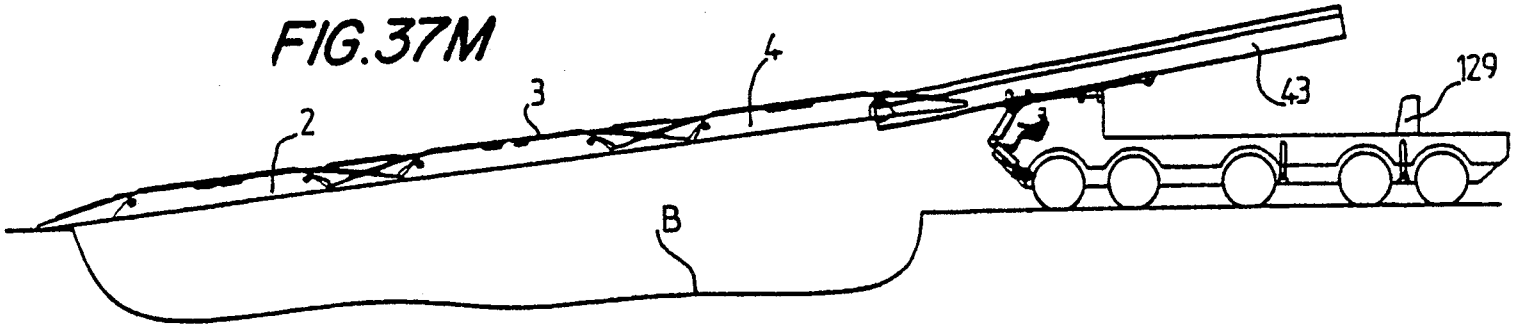
Figure 37N:
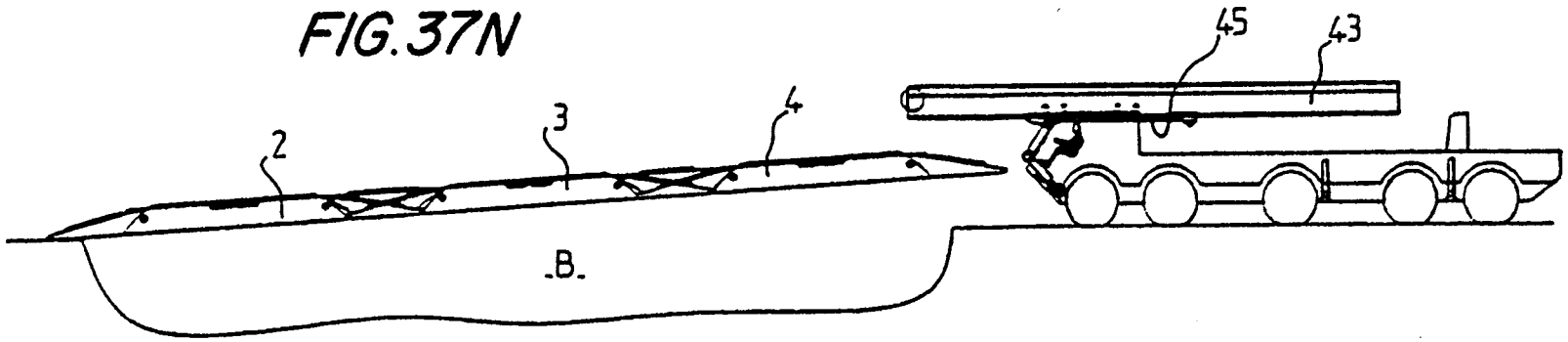
Figure 37O:
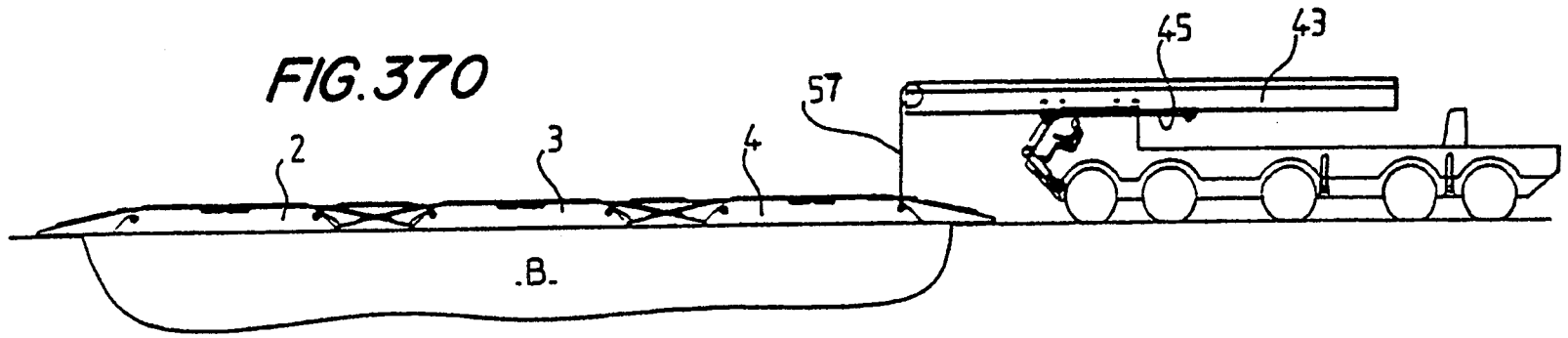

From the position shown on FIG. 37M, the motor-reducing gear set 51 is again put in operation to wind the cables 57 up onto the drums 56 and thus to bring the whole of the supporting plate 45 and the girder 43 back to the horizontal position as shown on FIG. 37N. In this depositing position the girder 43 has an overhang with respect to the vehicle relatively reduced by about the quarter of its full length. Then the motor 107 is energized for causing the hooks 93 to move downwards and thus for depositing the assembled spanning beams 2, 3, 4 over the breach B as shown on FIG. 37-O. The hooks 93 are then disengaged from the handling shafts 74 of the lower spanning beam 4 and the motor-reducing gear set 51 would bring the hooks 93 back to their position X. The motor 107 is disengaged from the plate 106 driving the shaft 105 and the girder 43 is brought back to the initial transport position. The vehicle may then clear the breach B by passing on the bridge provided by the assembled spanning beams 2, 3, 4 to recover the spanning beams on the opposite bank. The picking-up again of the spanning beams from the ground is of course effected according to the different steps considered when starting from FIG. 37-O and proceeding to FIG. 37A.

FIGS. 38A to 38H show the steps for depositing one single spanning beam, the upper spanning beam 2 in the present case.

Figure 38A:
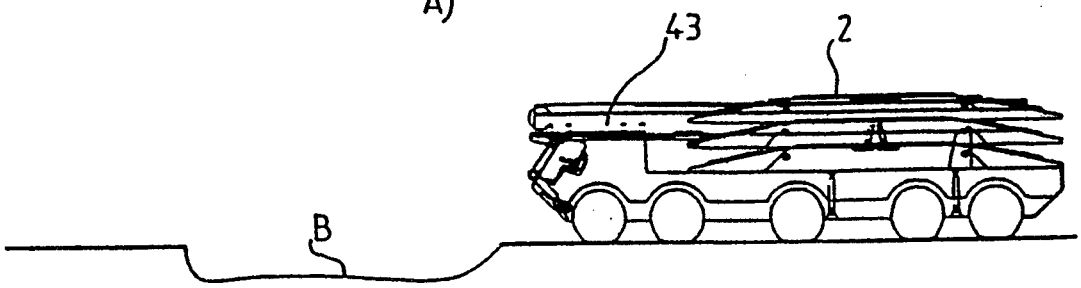
FIG. 38A to 38H show the different steps for laying down a spanning beam over a breach to be cleared.

From the transport position shown on FIG. 38A, the whole of the girder 43 and spanning beam 2 connected to the latter by the fork-like elements 72 is displaced in relation to the supporting plate 45 to an overhang or cantilever position forward of the vehicle in which the motor 107 is coupled to the plate 112 driving the shaft 111.

Figure 38B:
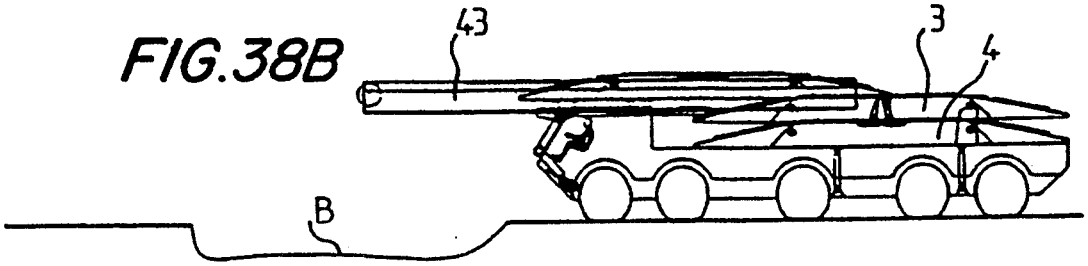
Figure 38C:
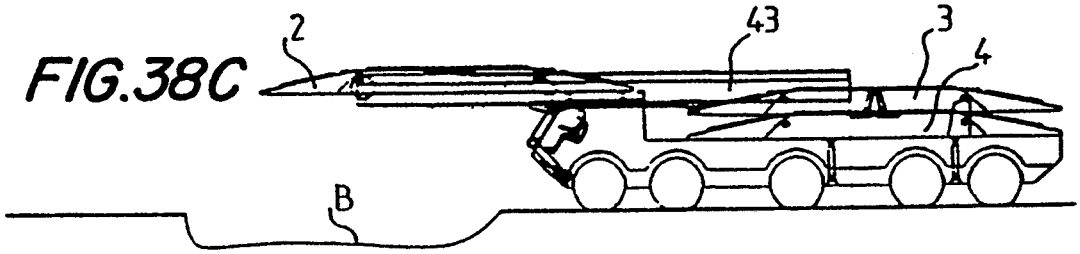

The spanning beam 2 is displaced in relation to the girder 43 from the position shown on FIG. 38B to the position shown on FIG. 38C in which the front handling shafts 74 of the spanning beam 2 are engaging and are locked themselves within the hooks 93 as already explained previously. The motor 107 is disengaged from the plate 112 driving the shaft 111.

Figure 38D:
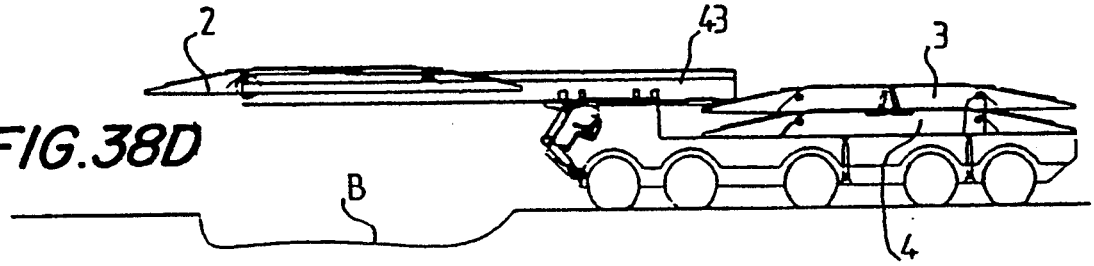

Then as shown on FIG. 38D, the girder 43 is displaced in relation to the supporting plate 45 to its most cantilever or overhang position forward of the vehicle in which the motor 107 is coupled to the plate 117 driving the shaft 116.

Figure 38E:
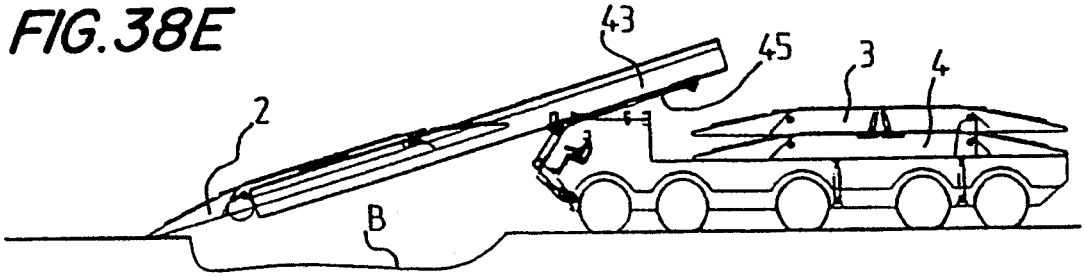
Figure 38F:
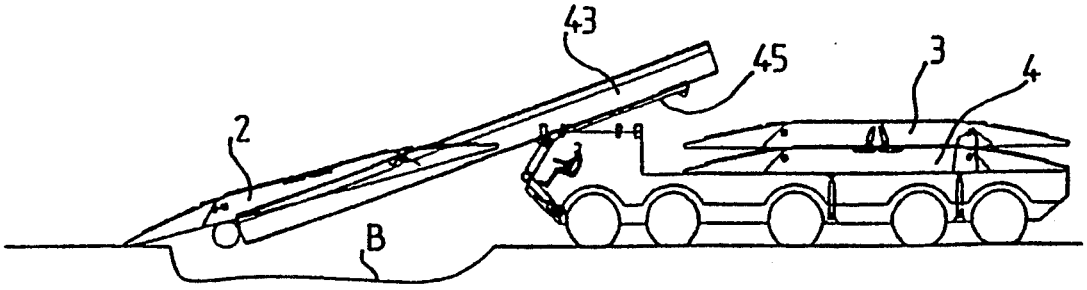
Figure 38G:
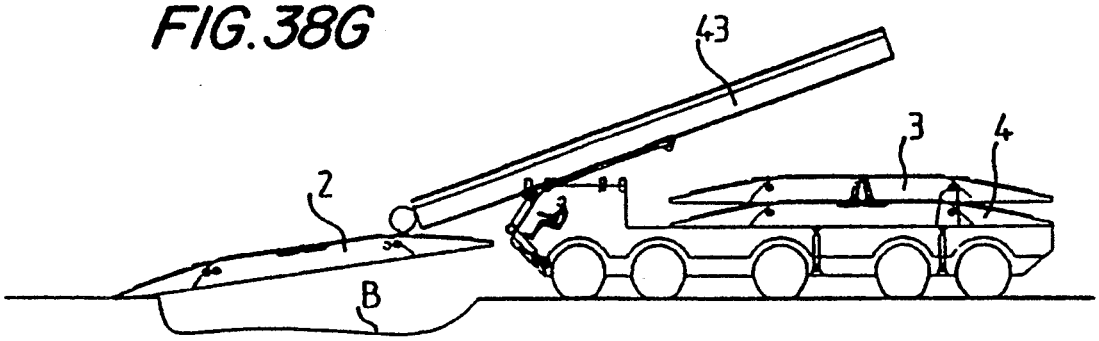

Prior to the tilting of the supporting plate 45-girder 43 system, the handling shafts 74 of the spanning beam 2 are unlocked from the hooks 93 in the manner already set forth previously and the hooks 93 are brought to the position X. FIG. 38E shows the tilting of the girder 43 and FIG. 38F shows how the end of the spanning beam 2 is caused to bear on the bank opposite to the vehicle with the spanning beam 2 defining an angle of about 3° with respect to the girder 43.

The girder 43 is then moved backwards in relation to the supporting plate 45 to a position identical with that of FIG. 37M, thereby displacing the chains 64 in a translatory motion on the toothed wheels 65, 66 so as to move the spanning beam 2 in relation to the girder 43 until the rear finger-like parts of the spanning beam 2 are automatically disengaging themselves from the fork-like elements 72 with the handling shafts 74 engaging and locking themselves in the hooks 93 which are brought to the position Z.

Figure 37P:
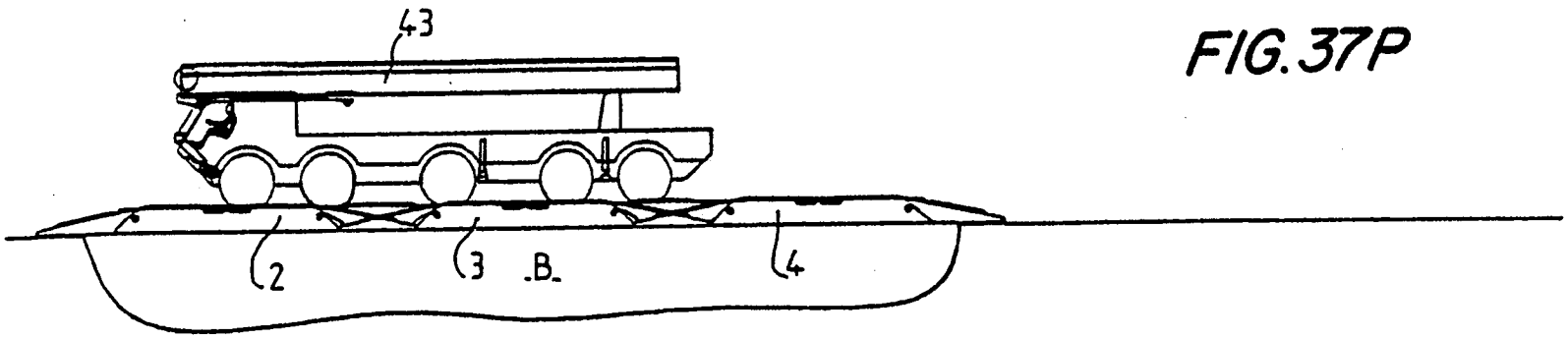
Figure 38H:
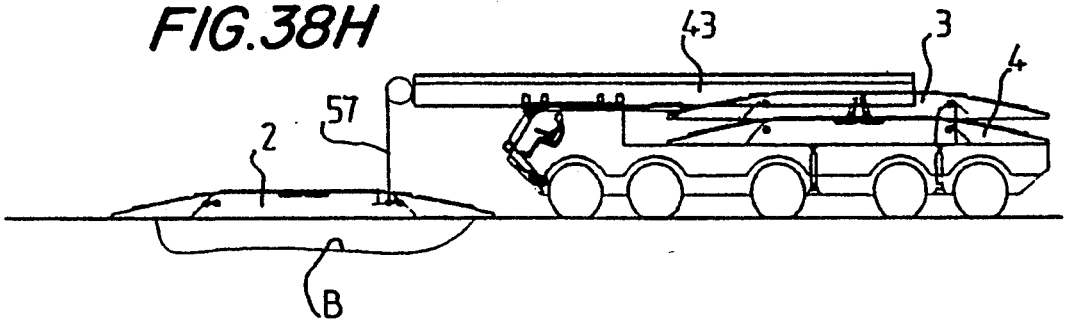

As shown on FIG. 38H, the whole of the supporting plate 45 and girder 43 is brought back to the horizontal position by the motor-reducing gear set 51 and the motor 107 is energized for lowering the hooks 93 hence for laying the spanning beam 2 down over the breach B. The various steps depicted on FIGS. 37-O and 37P are carried out in order that the vehicle passes over the breach B and may then take up the spanning beam according to the different steps considered when starting from FIG. 38H and proceeding to FIG. 38A.

The liftable jibs 8 of the spanning beam 2 are of course initially locked before the start of the steps of depositing thereof.

The steps of assembling and of depositing two spanning beams coupled end to end are obviously resulting from the steps depicted on FIGS. 37A to 37P and need therefore not to be described in detail.

The system according to the invention described hereinabove is of a relatively simple construction and operation in comparison with the systems known until now and especially would deposit one or several assembled spanning beams in a minimum time.

What is claimed is:

1. In a spanning beam structure for clearing breaches by vehicles and having at least one spanning beam element comprising a rigid central box with an upper trackway, said central box having a first end and a second end opposite to said first end, at least one movable access jib being coupled to one of said first and second ends of said central box for extending said upper trackway of said central box, said at least one of said access jibs being fastened to said central box by a transverse pivot pin to permit said at least one access jib to pivot about said pivot pin between a locked position and a raised position, and releasable locking means for locking said at least one access jib in said locked position, the improvement wherein said locking means comprise at least one jib locking shaft fixed to said at least one access jib, said jib locking shaft having a head, at least one box locking shaft fixed to said central box, said box locking shaft having a head, said at least one jib locking shaft and said at least one box locking shaft being aligned along a common axis and extending in a longitudinal direction of said central box when said at least one access jib is in said locked position with respect to said central box, such that said head of said at least one jib locking shaft confronts said head of said at least one box locking shaft, and two jaw-like members for releasably securing said heads of said at least one jib locking shaft and said at least one box locking shaft to lock said at least one access jib to said central box.

2. The spanning beam structure of claim 1, wherein the pivot pin of said at least one access jib is located at an upper part of the central box and said jib and box locking shafts are located in proximity to a bottom area of said at least one access jib and said central box, said jaw-like members being situated in a lower transverse space defined between said at least one access jib and said central box.

3. The spanning beam structure of claim 2, wherein said jaw-like members are arranged substantially in a direction transverse to the longitudinal direction of said central box.

4. The spanning beam structure of claim 1, wherein said locking means further comprise at least one retractable pin for taking up shearing forces exerted upon said jib and box locking shafts during passage of vehicles on said upper trackway, said at least one retractable pin extending longitudinally into coaxial holes in said at least one access jib and said central box.

5. The spanning beam structure of claim 4, wherein said locking means further comprise a block attached to said central box and having a hole coaxial to said holes in said central box and said at least one access jib, and a control rod having a threaded end screwed into said at least one retractable pin, said control rod being mounted in said block for axial rotation, said at least one retractable pin being retractable from said hole in said at least one access jib by said control rod so as to retract said at least one retractable pin into said hole in said central box upon unlocking of said at least one access jib from said central box.

6. The spanning beam structure of claim 5, wherein said locking means further comprise motion control means connected to said control rod for operating said jaw-like members, said control means comprising a plate guided in longitudinal motion by said control rod and having oblique grooves, a stud fixed to each of said jaw-like members and being insertable into said oblique grooves in said plate such that movement of said plate by said control rod causes said jaw-like members to move toward or away from each other to grip said heads of said jib and box locking shafts.

7. The spanning beam structure of claim 6, wherein said locking means further comprise guide means for guiding movement of said jaw-like members toward and away from each other.

8. The spanning beam structure of claim 7, wherein said guide means comprise at least one shaft attached to said central box.

9. The spanning beam structure of claim 6, wherein said locking means further comprise a reducing mechanism coupled to said control means of said jaw-like members, said reducing mechanism being fixed to a bottom area of said central box.

10. The spanning beam structure of claim 6, wherein said control rod comprises a transverse pin fixed to said plate through a longitudinal groove formed in a wall of said block.

11. The spanning beam structure of claim 10, wherein said locking means further comprise L-shaped parallel guide rails to secure said plate to said block.

12. The spanning beam structure of claim 1, wherein said at least one access jib has a hook-shaped portion at an end thereof, said spanning beam structure further comprising an additional, corresponding spanning beam element arranged adjacent to said at least one spanning beam element to be operatively connected therewith, said additional spanning beam element comprising a stationary access jib comprising a transverse bar for locking said hook-shaped portion of said at least one access jib, separating means for separating said hook-shaped portion from said transverse bar, said separating means comprising a jack fixed to said additional access jib and having a jack rod for lifting said at least one access jib, said stationary access jib further comprising at least one locking shaft extending in the longitudinal direction of said central box and additional jaw-like members for locking said at least one jib locking shaft to said at least one box locking shaft of said at least one spanning beam element when said at least one access jib of said at least one spanning beam element is locked to said transverse bar of said stationary access jib of said additional spanning beam element.

13. The spanning beam structure of claim 1, further comprising two spanning beam elements having parallel upper trackways and connecting arms for connecting said central boxes of said two spanning beam element to each other, said two connecting arms forming braces.

14. The spanning beam structure of claim 1, wherein said at least one movable access jib is coupled to said first end of said central box, said at least one spanning beam element further comprising a stationary access jib arranged on said second side of said central box.

15. The spanning beam structure of claim 14, further comprising a first and second one of said spanning beam elements arranged adjacent each other such that said stationary access jib on said first spanning beam element is locked to said movable access jib on said second spanning beam element.

* * * * *